US007911386B1

(12) United States Patent
Itoh et al.

(10) Patent No.: US 7,911,386 B1
(45) Date of Patent: Mar. 22, 2011

(54) MULTI-BAND RADIATING ELEMENTS WITH COMPOSITE RIGHT/LEFT-HANDED META-MATERIAL TRANSMISSION LINE

(75) Inventors: Tatsuo Itoh, Rolling Hills, CA (US); Anthony Lai, Los Angeles, CA (US); Kevin M. K. H. Leong, Los Angeles, CA (US)

(73) Assignee: The Regents of the University of California, Oakland, CA (US)

( * ) Notice: Subject to any disclaimer, the term of this patent is extended or adjusted under 35 U.S.C. 154(b) by 973 days.

(21) Appl. No.: 11/751,852

(22) Filed: May 22, 2007

Related U.S. Application Data

(60) Provisional application No. 60/802,947, filed on May 23, 2006.

(51) Int. Cl.
*H01Q 1/38* (2006.01)
*H01Q 9/00* (2006.01)
*H01Q 15/02* (2006.01)

(52) U.S. Cl. ..... 343/700 MS; 343/749; 343/909

(58) Field of Classification Search ..... 343/700 MS, 343/749, 846, 909
See application file for complete search history.

(56) References Cited

U.S. PATENT DOCUMENTS

| | | | | |
|---|---|---|---|---|
| 4,565,984 | A | 1/1986 | Castera et al. | |
| 5,511,238 | A | 4/1996 | Bayraktaroglu | |
| 5,872,491 | A | 2/1999 | Kim et al. | |
| 5,874,915 | A | 2/1999 | Lee et al. | |
| 6,426,722 | B1 | 7/2002 | Sievenpiper et al. | |
| 6,472,950 | B1 | 10/2002 | London | |
| 6,525,695 | B2 | 2/2003 | McKinzie, III | |
| 6,552,696 | B1 | 4/2003 | Sievenpiper et al. | |
| 7,068,234 | B2 | 6/2006 | Sievenpiper | |
| 7,196,666 | B2 | 3/2007 | Allen et al. | |
| 7,205,941 | B2 | 4/2007 | Wang et al. | |
| 7,256,753 | B2 | 8/2007 | Werner et al. | |
| 7,330,090 | B2 * | 2/2008 | Itoh et al. | 333/219 |
| 7,391,288 | B1 | 6/2008 | Itoh et al. | |
| 7,446,712 | B2 * | 11/2008 | Itoh et al. | 343/700 MS |

(Continued)

FOREIGN PATENT DOCUMENTS

JP 50037323 A 4/1975

(Continued)

OTHER PUBLICATIONS

C. Caloz et al. A novel composite right/left-handed coupled-line directional coupler with arbitrary coupling level and broad bandwidth. IEEE Transactions on Microwave Theory and Techniques, vol. 52, No. 3, pp. 980-991 (2004).

(Continued)

*Primary Examiner* — Shih-Chao Chen
(74) *Attorney, Agent, or Firm* — John P. O'Banion

(57) ABSTRACT

Dual-band and multi-band radiating elements are described based on composite right/left-handed (CRLH) meta-material transmission line (TL). These elements can operate as resonators and/or antennas depending on feed-line configuration. The radiating elements are based on the fundamental backward wave supported by a composite right/left-handed (CRLH) meta-material transmission line (TL). Unit-cells of the transmission line comprise conductive patches coupled through vias to a ground plane. The physical size and operational frequencies of the radiating element is determined by the unit cell of the CRLH meta-material. This radiating element is configured for monopolar radiation at a first resonant frequency and patch-like radiation at a second resonant frequency. The first and second resonant frequencies are not constrained to a harmonic relationship.

16 Claims, 19 Drawing Sheets

U.S. PATENT DOCUMENTS

| | | | | |
|---|---|---|---|---|
| 7,764,232 | B2 * | 7/2010 | Achour et al. | 343/700 MS |
| 2002/0167342 | A1 | 11/2002 | Ishizaki et al. | |
| 2003/0011522 | A1 | 1/2003 | McKinzie, III et al. | |
| 2003/0071697 | A1 | 4/2003 | Souetinov et al. | |
| 2004/0066251 | A1 | 4/2004 | Eleftheriades et al. | |
| 2004/0140862 | A1 | 7/2004 | Brown et al. | |
| 2004/0227668 | A1 | 11/2004 | Sievenpiper | |
| 2005/0225492 | A1 | 10/2005 | Metz | |
| 2005/0253667 | A1 | 11/2005 | Itoh et al. | |
| 2006/0066422 | A1 | 3/2006 | Itoh et al. | |
| 2006/0145927 | A1 | 7/2006 | Choi et al. | |
| 2008/0048917 | A1 | 2/2008 | Achour et al. | |
| 2008/0204327 | A1 | 8/2008 | Lee et al. | |

FOREIGN PATENT DOCUMENTS

KR 1020030022407 A 3/2003

OTHER PUBLICATIONS

C. Caloz et al. A broadband left-handed coupled-line backward coupler with arbitrary coupling level. IEEE MTT-S International Microwave Symposium, Jun. 7-13, 2003, pp. 317-318.

A. Lai et al. Composite right/left handed transmission line metamaterials. IEEE Microwave Magazine, Sep. 2004, pp. 34-50.

A. Lai et al. Dual-mode compact microstrip antenna based on fundamental backward wave. Proceedings of Asia-Pacific Microwave Conference, Suzhou, China, Dec. 4-7, 2005, vol. 4, pp. xx. (See the abstract, figures 3 and 5, and 2nd and 3rd pages).

L. Liu et al. Forward coupling phenomena between artificial left-handed transmission lines. J. Applied Physics, vol. 92, No. 9, Nov. 2002, pp. 5560-5565.

R. B. Waterhouse, S. D. Targonski, and D. M. Kokotoff, "Design and performance of small printed antennas." IEEE Trans. on Antennas and Prop., vol. 46, No. 11, pp. 1629-1633, Nov. 2003.

J.S. Dahele, K.F. Lee, and D.P. Wong, "Dual-frequency stacked annular-ring microstrip antenna," IEEE Trans. Antennas Propagat., vol. 35, No. 11, pp. 1281-1285, Nov. 1987.

R. Nunes, A. Moleiro, J. Rosa, and C. Peixeiro, "Dual-band microstrip patch antenna element with shorting pins for GSM," IEEE Antennas and Propagation Society Int.Symp., vol. 2, pp. 16-21, Jul. 2000.

CH. Delaveaud, PH. Leveque, and B. Jecko, "New kind of microstrip antenna: the monopolar wire-patch antenna," Electronic Letters, vol. 30, No. 1, pp. 1-2, Jan. 1994.

S. Otto, C. Caloz, A. Sanada, and T. Itoh, "A dual-frequency composite right/left-handed half-wavelength resonator antenna," Asia-Pacific Microwave Conference, Dec. 2004.

A. Lai, C. Caloz, and T. Itoh, "Composite right/left-handed transmission line metamaterials," IEEE Microwave Magazine, vol. 5, No. 3, pp. 34-50, Sep. 2004.

A. Sanada, M. Kimura, I. Awai, H. Kubo, C. Caloz, and T. Itoh, "A planar zeroth-order resonator antenna using a left-handed transmission line," European Microwave Conference, Oct. 2004.

C. Lee, K.M.K.H. Leong, and T. Itoh, "Design of resonant small antenna using composite right/left-handed transmission line," IEEE Antennas and Propagation Society Int.Symp., Jun. 2005.

A. Sanada, C. Caloz, and T. Itoh, "Novel Zeroth order resonance in composite right/left-handed transmission line resonators," Asia-Pacific Microwave Conference, vol. 3, pp. 1588-1592, Seoul, Korea, Nov. 2003.

D. Sievenpiper, L.Zhang, F.J. Broas, N.G. Alexopulos, and E. Yablonovitch, "High-impedance electromagnetic surfaces with a forbidden frequency band," IEEE Trans. Microwave Theory Tech., vol. 47, No. 11, pp. 2059-2074, Nov. 1999.

V. G. Veselago, "The electrodynamics of substances with simultaneously negative values of (epsilon) and (mu) ," Soviet Physics Uspekhi, vol. 10, No. 4, pp. 509-514, Jan. 1968.

R. A. Shelby, D. R. Smith, and S. Schultz, "Experimental verification of a negative index of refraction," Science, vol. 292, pp. 77-79, Apr. 2001.

C. Caloz, H. Okabe, T. Iwai, and T. Itoh, "Transmission line approach of left-handed (LH) materials," USNC/URSI National Radio Science Meeting, vol. 1, p. 39, San Antonio, TX, Jun. 2002.

M. Schüssler, J. Freese, and R. Jakoby, "Design of compact planar antennas using LH-transmission lines," IEEE MTT-S International Microwave Symposium, vol. 1, pp. 209-212, Jun. 2004.

A. Lai, K.M.K.H. Leong, and T. Itoh, "A Novel N-Port Series Divider Using Infinite Wavelength Phenomena," IEEE-MTT Int. Symp. Dig., Long Beach, CA, Jun. 2005.

J.S. Row, S.H. Yeh, and K.L. Wong, "A wide-band monopolar plate-patch antenna," IEEE Trans. Antennas Propag., vol. 50, No. 9, pp. 1328-1330, Sep. 2002.

K.L. Lau, P. Li, and K.M. Luk, "A monopolar patch antenna with very wide impedance bandwidth," IEEE Trans. Antennas Propag., vol. 53, No. 2, Feb. 2005.

C. Decroze, G. Villemaud, F. Torres, and B. Jecko, "Single feed dual-mode wire patch antenna," IEEE Antennas and Propagation Society Int. Symp., vol. 1, No. 11, pp. 22-25, Jun. 2002.

A. Sanada, C. Caloz, and T. Itoh, "Planar distributed structures with negative refractive index," IEEE Trans. Microwave Theory Tech., vol. 52, No. 4, pp. 1252-1263, Apr. 2004.

A. Lai, K.M.K.H. Leong, and T. Itoh, "Dual-mode compact microstrip antenna based on fundamental backward wave," 2005 Asia Pacific Microwave Conference, Suzhou, China, Dec. 2005.

E. Chang, S.A. Long, and W.F. Richards, "An experimental investigation of electrically thick rectangular microstrip antennas," IEEE Trans. Antennas Propag., vol. 34, No. 6, pp. 767-772, Jun. 1986.

N. Mercé, P. Tejedor, and J. Vassal'lo, "The TM01 mode of microstrip radiators and some of its applications," IEEE Antennas and Propagation Society Int. Symp., No. 407, pp. 33-36, Apr. 1995.

C. Martín-Pascual and I. Seoane, "On the generation and applications of the monopolar ("zeroth" like) mode in non-circular patches," 17th International Conference on Applied Electromagnetics and Communications, Dubrovnik, Croatia, pp. 160-163, Oct. 2003.

* cited by examiner

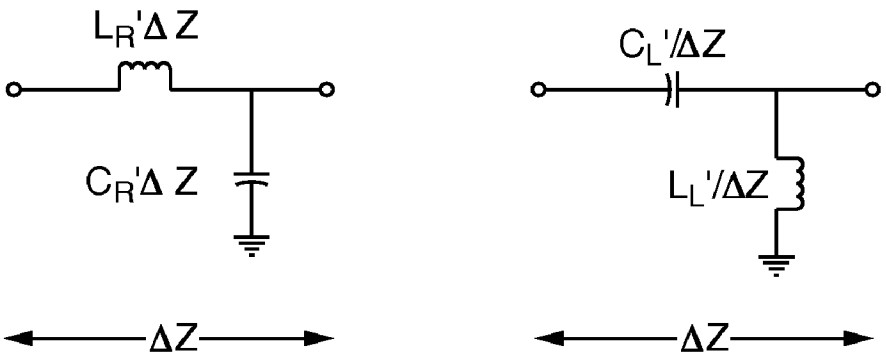
FIG. 9A
FIG. 9B
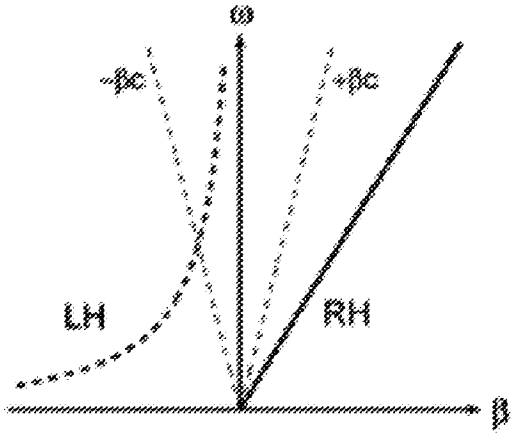
FIG. 9C

MULTI-BAND RADIATING ELEMENTS WITH COMPOSITE RIGHT/LEFT-HANDED META-MATERIAL TRANSMISSION LINE

CROSS-REFERENCE TO RELATED APPLICATIONS

This application claims priority from U.S. provisional application Ser. No. 60/802,947, filed on May 23, 2006, incorporated herein by reference in its entirety.

STATEMENT REGARDING FEDERALLY SPONSORED RESEARCH OR DEVELOPMENT

This invention was made with Government support under Contract N00014-01-1-0803 awarded by the U.S. Navy/Office of Naval Research. The Government has certain rights in this invention.

INCORPORATION-BY-REFERENCE OF MATERIAL SUBMITTED ON A COMPACT DISC

Not Applicable

NOTICE OF MATERIAL SUBJECT TO COPYRIGHT PROTECTION

A portion of the material in this patent document is subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. §1.14.

A portion of the material in this patent document is also subject to protection under the maskwork registration laws of the United States and of other countries. The owner of the maskwork rights has no objection to the facsimile reproduction by anyone of the patent document or the patent disclosure, as it appears in the United States Patent and Trademark Office publicly available file or records, but otherwise reserves all maskwork rights whatsoever. The maskwork owner does not hereby waive any of its rights to have this patent document maintained in secrecy, including without limitation its rights pursuant to 37 C.F.R. §1.14.

BACKGROUND OF THE INVENTION

1. Field of the Invention

This invention pertains generally to communications antennas, and more particularly to dual-band and multi-band antennas formed from composite right/left-handed transmission lines.

2. Description of Related Art

To satisfy the demands of compact and versatile wireless communication systems, a compact and dual-band and multi-band antenna is desirable. Antennas of this nature are required in various wireless systems, such as GSM/DCS cellular communication systems, and synthetic aperture radar (SAR) systems. Traditional dual-band antennas have been implemented by modifying a conventional microstrip patch antenna by operating it at different harmonics, adding an additional resonator, or by reactively loading the patch antenna with shorting pins. These antennas function at two different frequencies but have similar radiation patterns at each frequency. These dual-band methods have additional drawbacks, including that the operational frequencies are limited to integer multiples of the fundamental mode by operating at different harmonics, while the physical size requirement increases when adding another resonator. In the case of reactive loading, the placement and the number of required shorting pins is not easily determined.

Accordingly, a need exists for a system and method of creating compact dual-band and multi-band antennas which are not subject to the size, pattern and operational limits of conventional antenna radiators. These needs and others are met within the present invention, which overcomes the deficiencies of previously developed antenna system and methods.

BRIEF SUMMARY OF THE INVENTION

The drawbacks associated with conventional dual-band and multi-band antennas can be overcome by implementing dual-band and multi-band antennas with a composite right/left-handed (CRLH) meta-material transmission line (TL) which has several unique features such as a nonlinear dispersion relation. For the sake of simplicity of description, the radiating elements according to the invention are referred to as "antennas", however, it should be appreciated that both antennas and resonators are similarly formed while being subject to different signal feed configurations.

Recent research into meta-materials based on periodic unit-cells for microwave applications has grown rapidly with the verification of left-handed (LH) meta-materials. In particular, the transmission line approach of LH meta-materials has led to the realization of the composite right/left-handed (CRLH) transmission line (TL) which includes LH and right-handed (RH) attributes. The CRLH TL has many unique properties such as supporting a fundamental backward wave (anti-parallel group and phase velocities) and zero propagation constant ($\beta=0$) with zero or non-zero group velocity at a discrete frequency. The backward wave property of the CRLH TL and other LH-based TLs has been used to realize novel, small half-wavelength resonant antennas. The infinite wavelength property ($\beta=0$, $\omega\neq0$) of the CRLH TL has been used to realize several size-independent resonant structures such as the zeroeth-order resonator and infinite wavelength series divider.

The operational frequencies of the dual-band CRLH half-wavelength antenna implemented in S. Otto, C. Caloz, A. Sanada, and T. Itoh, "A dual-frequency composite right/left-handed half-wavelength resonator antenna," *Asia-Pacific Microwave Conference*, December 2004 are not harmonics of each other because of the nonlinear dispersion relation of the CRLH TL. Since the dispersion relation of the CRLH TL is strictly determined by its unit-cell, the operational frequencies of the antenna can be controlled by modifying the unit-cell and/or the number of unit-cells. Unlike other reactively loaded dual-band and multi-band antenna approaches, the CRLH TL approach offers a more straight-forward design approach based on the dispersion relation of the CRLH TL unit-cell.

Accordingly, an aspect of the invention is a dual-mode compact microstrip antenna based on the fundamental backward wave supported by a composite right/left-handed (CRLH) meta-material transmission line (TL). The physical size and operational frequencies of the antenna are determined by the unit-cell of the CRLH meta-material. For example, this antenna is capable of monopolar radiation at one resonant frequency and patch-like radiation at another resonant frequency.

Additionally, since an infinite wavelength occurs when the propagation constant is zero, the frequency of the antenna does not depend on its physical length, but only on the reactance provided by its unit-cell. Therefore, the physical size of the antenna can be arbitrary; this is useful in realizing electrically small or electrically large antennas. By properly designing the unit-cell, the radiation pattern of the antenna at the infinite wavelength frequency can also be tailored.

Accordingly, another aspect of the invention is that the CRLH TL unit-cell provides a general model for the required unit-cell consisting of a series capacitance, a series inductance, a shunt capacitance, and a shunt inductance. The shunt resonance of the CRLH TL unit-cell determines the infinite wavelength frequency and thus the operational frequency of the antenna. As a result, a CRLH TL unit-cell without series capacitance referred to as an inductor-loaded TL unit-cell can also be used to realize the antenna. By modifying the equivalent shunt capacitance and/or shunt inductance circuit parameters of the unit-cell, the operational frequency and the physical size of the realized antennas can be controlled.

Furthermore, the unique "equal amplitude/phase" electric-field distribution of an infinite wavelength excited on the antenna gives rise to monopolar radiation pattern. In one embodiment, a dual-mode microstrip antenna includes a plurality of composite right/left-handed transmission line unit-cells which form a resonator. Each unit-cell of the resonator comprises a conductive patch (e.g., preferably metal) connected to a ground plane through a via, and in which the antenna radiates in a monopolar pattern. In one embodiment, the unit-cells are spaced apart by a gap. In one embodiment, the left-hand (LH) attribute of capacitance $C_L$ arises in response to a gap between each of the unit-cells, while inductance $L_L$ arises in response to the via. In one embodiment, right-hand (RH) attributes are due to the current flow ($L_R$) on the unit-cell and from an electric field between the metal patch and the ground plane ($C_R$). In one embodiment, changing the equivalent circuit parameters of the unit-cell, the operational frequencies of the antenna can be controlled without changing its physical size. In one embodiment, the antenna is capable of monopolar radiation at a first resonant frequency and patch-like radiation at a second resonant frequency. In one embodiment, the operational frequencies of the antenna are not constrained to be harmonics of one other, and the operational frequencies of the antenna are controlled by modifying the dispersion relation of the CRLH unit-cell. In one embodiment, physical size and operational frequencies of the antenna are determined by the configuration of the CRLH meta-material unit-cell.

At least one embodiment of the invention is a multi-mode resonant radiating element, comprising: (a) a plurality of composite right/left-handed (CRLH) transmission line (TL) unit-cells configured for operation at multiple radio frequency bands; (b) each unit-cell comprising a conductive patch connected to a ground plane through a via connection, wherein a plurality of unit-cells form a resonator; (c) wherein the radiating element radiates an $i^{th}$ radiation pattern at the $i^{th}$ resonant frequency, and a $j^{th}$ radiation pattern at a different $j^{th}$ resonant frequency; and (d) wherein said $i^{th}$ radiation pattern is of a different shape than said $j^{th}$ radiation pattern.

At least one embodiment of the invention is a dual-mode resonant radiating element, comprising: (a) a plurality of composite right/left-handed (CRLH) transmission line (TL) unit-cells configured for operation at an infinite wavelength; (b) each said unit-cell comprising a conductive patch connected to a ground plane through a via; and (c) said plurality of unit-cells forming a resonator; (d) wherein said radiating element radiates a first radiation pattern at a first resonant frequency, and a second radiation pattern at a second resonant frequency; and (e) wherein said first radiation pattern differs (e.g., different pattern shape) from said second radiation pattern. It will be appreciated that the radiating element may comprise a resonator and/or an antenna depending on the feed configuration adopted.

At least one embodiment of the invention may be a dual-mode resonant antenna, comprising: (a) a plurality of composite right/left-handed (CRLH) transmission line (TL) unit-cells; (b) each said unit-cell comprising a conductive patch connected to a ground plane through a via; and (c) said plurality of unit-cells forming a resonator. The antenna radiates a first radiation pattern at a first resonant frequency, and a second radiation pattern at a second resonant frequency. In a preferred embodiment the first radiation pattern provides a different shape than the second radiation pattern. In at least one embodiment the first radiation pattern is a monopolar radiation pattern, and the second radiation pattern is a patch-like radiation pattern. The first resonant frequency operates at n=0 supporting an infinite wavelength of the CRLH TL. The second resonant frequency (e.g., determined by dispersion relation and number of unit-cells) operates at n=−1 supporting a half-wavelength of the CRLH TL. The antenna, or resonator, operates in response to the fundamental backward wave of the CRLH TL, in which the supported wavelength is proportional to the operational frequency and the infinite wavelength supported by the CRLH TL at a finite frequency. One significant advantage is that the first and second resonant frequencies of the antenna are not limited to being harmonics of one another.

Each of the unit-cells within the antenna/resonator comprises a plurality of vias connecting at least one conductive plate to a ground plane. In at least one embodiment, a conductive plate serves across a number of unit cells. In another embodiment, separate conductive plates (e.g., separated by a non-conductive gap) are coupled to each of the vias, or alternatively a group of vias.

At least one embodiment of the invention may be a dual-mode microstrip antenna, comprising: (a) a plurality of composite right/left-handed (CRLH) transmission line (TL) unit-cells; (b) said plurality of unit-cells forming a resonator; (c) each said unit-cell comprising a metal patch connected to a ground plane through a via. The antenna radiates according to a first pattern, such as monopolar. Left-hand (LH) attributes arise in response to both the gap between the unit-cells, which provides capacitance $C_L$, and the current through the via, which provides inductance $L_L$. Right-hand (RH) attributes are due to the current flow on the unit-cell from which inductance ($L_R$) arises, and from an electric field between the conductive patch (e.g., metallic) and the ground plane from which capacitance ($C_R$) arises. In response to changing the equivalent circuit parameters of the unit-cell, the operational frequencies of the antenna can be controlled without changing its physical size. The antenna/resonator is capable of monopolar radiation at a first resonant frequency and patch-like radiation at a second resonant frequency.

At least one embodiment of the invention is a dual-mode resonant radiating element, comprising: (a) a plurality of composite right/left-handed (CRLH) transmission line (TL) unit-cells configured for operation in two frequency bands; (b) a plurality of separate conductive patches; (c) a ground plane; and (d) a plurality of vias coupled between each of said plurality of conductive patches and said ground plane forming a composite right/left-handed (CRLH) transmission line unit-cell implementation; (e) wherein the vias of each unit-cell provide inductance $L_L$ as a left-handed (LH) attribute; (f) wherein said unit-cells are spaced apart by a gap from which capacitance $C_L$ arises as a left-handed (LH) attribute; (g) wherein right-handed (RH) attributes arise in response to inductance $L_R$ from current flow on the unit-cell, and in response to capacitance $C_R$ from an electric field between the conductive patch and the ground plane; (h) wherein each said unit-cell, in said plurality of units-cells, comprises a single patch coupled through a single via to said ground plane; (i) wherein said radiating element radiates a monopolar radiation pattern at a first resonant frequency, and a patch-like radiation pattern at a second resonant frequency; and (j) wherein the first and second resonant frequencies are not constrained to being harmonics of one another.

At least one embodiment of the invention is a dual-mode resonant radiating element, comprising: (a) a plurality of composite right/left-handed (CRLH) transmission line (TL) unit-cells configured for operation in two frequency bands; (b) at least one conductive patch; (c) a ground plane; and (d) a plurality of vias coupled between said at least one conductive patch and said ground plane forming an inductor-loaded transmission line (TL); (e) wherein the via provides an inductance $L_L$ as a left-handed (LH) attribute; (f) wherein right-handed (RH) attributes arise in response to inductance $L_R$ from current flow on the unit-cell, and in response to capacitance $C_R$ from an electric field between the conductive patch and the ground plane; (g) wherein said radiating element radiates a monopolar radiation pattern at a first resonant frequency, and a patch-like radiation pattern at a second resonant frequency; and (h) wherein the first and second resonant frequencies are not constrained to being harmonics of one another.

An aspect of the invention is a compact dual-band and multi-band radiating element based on CRLH meta-material transmission line.

Another aspect of the invention is that the radiating element can be configured as an antenna and/or resonator in response to feed configuration.

Another aspect of the invention is an antenna supporting differently-shaped radiation patterns for each of its bands.

Another aspect of the invention is an antenna configured for monopolar radiation at one resonant frequency and patch-like radiation at another resonant frequency.

Another aspect of the invention is an antenna having an arbitrary physical size, which need not be related to its operating wavelengths.

Another aspect of the invention is an antenna based on the fundamental infinite wavelength property of the CRLH TL.

Another aspect of the invention is an antenna based on the fundamental backward wave of the CRLH TL.

Another aspect of the invention is an antenna which does not require reactively loading with shorting pins.

Another aspect of the invention is an antenna whose operating frequencies are not limited to integer multiples of the fundamental mode in response to operating at different harmonics.

Another aspect of the invention is an antenna in which the operational frequencies of the antenna are not harmonics of each other.

Another aspect of the invention is an antenna where the operational frequencies of the antenna can be controlled by modifying the dispersion relation of the CRLH unit-cell.

Another aspect of the invention is an antenna where the physical size and operational frequencies are determined by CRLH meta-material unit cell design.

Another aspect of the invention is an antenna whose operating frequencies do not depend on physical length and/or size constraints, but only on the reactance of its unit-cell.

Another aspect of the invention is an antenna/resonator having a dispersion relation determined by the structure of its constituent unit-cells.

Another aspect of the invention is an antenna whose supported wavelength is proportional to the operational frequency and the infinite wavelength supported by the CRLH TL at a finite frequency.

Another aspect of the invention is a multi-mode compact microstrip antenna based on the fundamental backward wave supported by a composite right/left-handed (CRLH) meta-material transmission line (TL).

Another aspect of the invention is an antenna using a CRLH TL unit-cell comprising a series capacitance, a series inductance, a shunt capacitance, and a shunt inductance.

Another aspect of the invention is a CRLH TL unit-cell where the shunt resonance determines the infinite wavelength frequency and thus the operational frequency of the antenna.

Another aspect of the invention is an antenna using a CRLH TL unit-cell in which modification of equivalent shunt capacitance and/or shunt inductance of the unit-cell changes the operational frequency and/or physical size.

Further aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

FIG. 9A is a schematic of an infinitesimal circuit model RH TL according to an aspect of the present invention.

FIG. 9B is a schematic of an infinitesimal circuit model LH TL according to an aspect of the present invention.

FIG. 9C is a schematic of a dispersion diagram of an RH TL and LH TL according to aspects of the present invention.

FIG. 12 is a graph of resonance peaks of open-ended resonators shown in

Figure 11A:
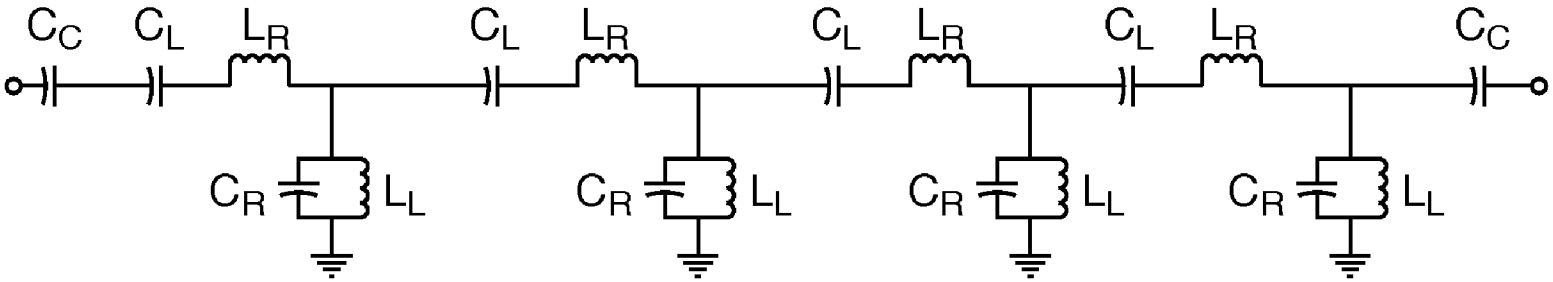
FIG. 11A is a schematic of a four-cell open-ended resonator with a CRLH TL unit cell according to an aspect of the present invention.
Figure 11B:
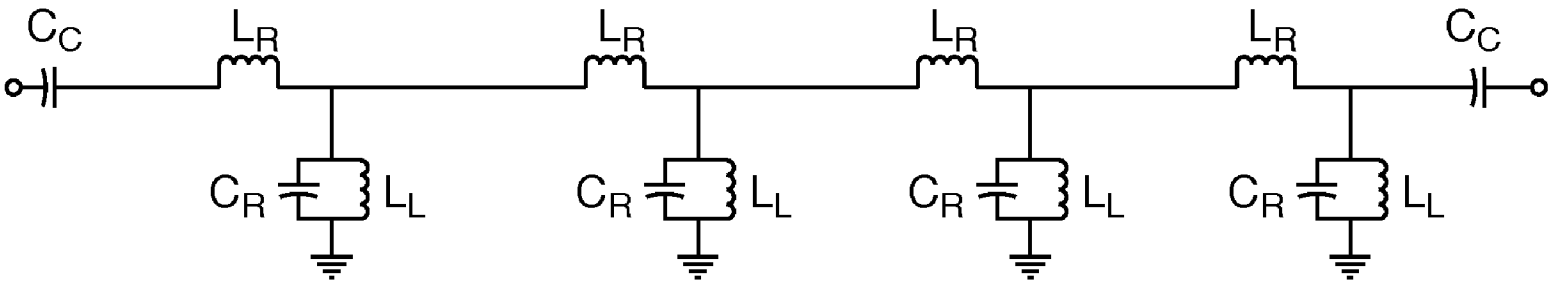
FIG. 11B is a schematic of a four-cell open-ended resonator with no series capacitance components according to an aspect of the present invention.

FIG. 11A, and FIG. 11B.

Figure 13A:
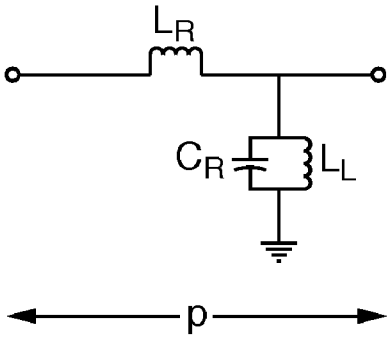

FIG. 13A is a schematic of an inductor-loaded TL having an LC of length p according to an aspect of the present invention.

Figure 13B:
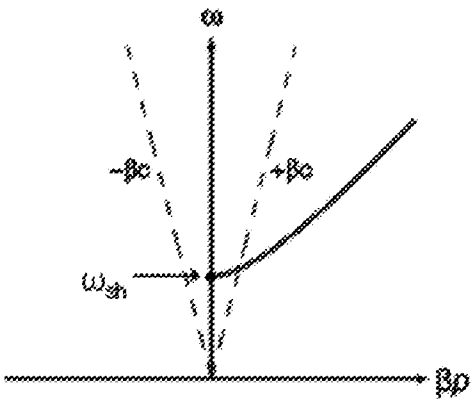

FIG. 13B is a graph of dispersion for the TL of FIG. 13A.

Figure 14B:
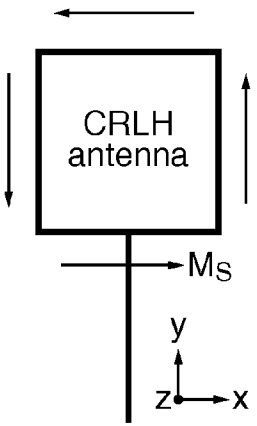
Figure 14A:
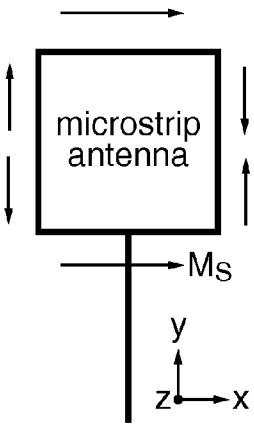

FIG. 14A is a schematic of a conventional microstrip patch antenna which is resonant along the Y direction and which supports half-wavelength.

FIG. 14B is a schematic of a CRLH patch antenna which is resonant along the Y direction and which supports an infinite-wavelength.

Figure 15:
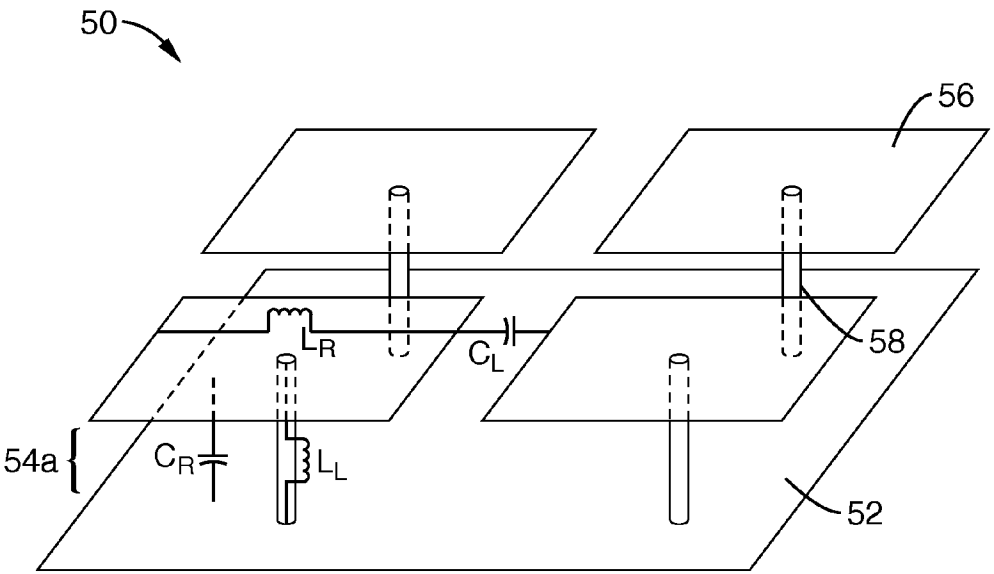

FIG. 15 is a schematic of a microstrip CRLH TL based on a high-impedance surface according to an aspect of the present invention.

Figure 16B:
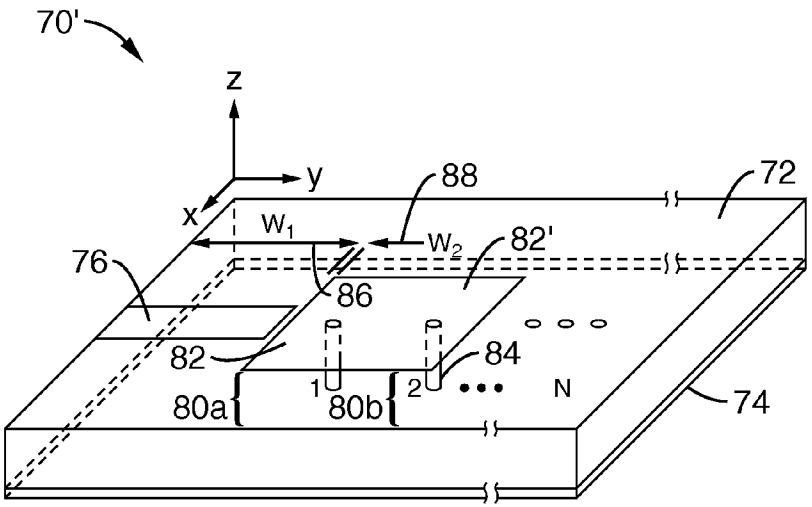
Figure 16A:
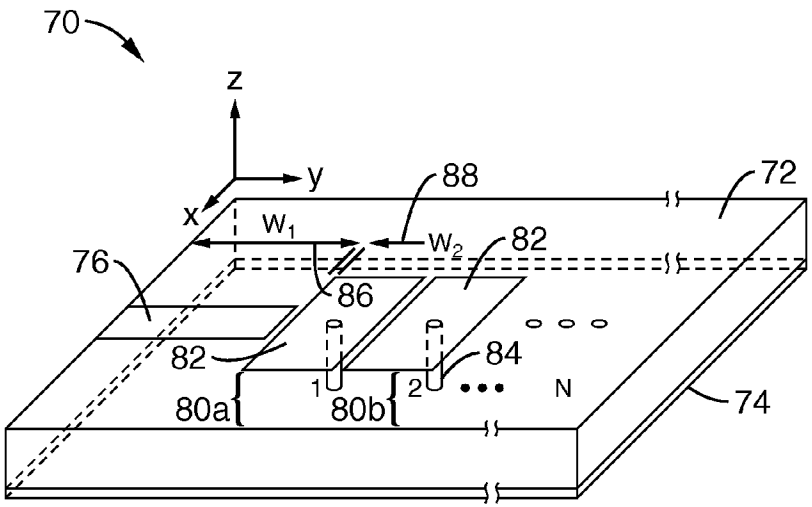

FIG. 16A is a schematic of a CRLH TL antenna of two unit-cells according to an aspect of the present invention.

FIG. 16B is a schematic of an inductor-loaded TL two unit-cell implementation according to an aspect of the present invention.

Figure 17:
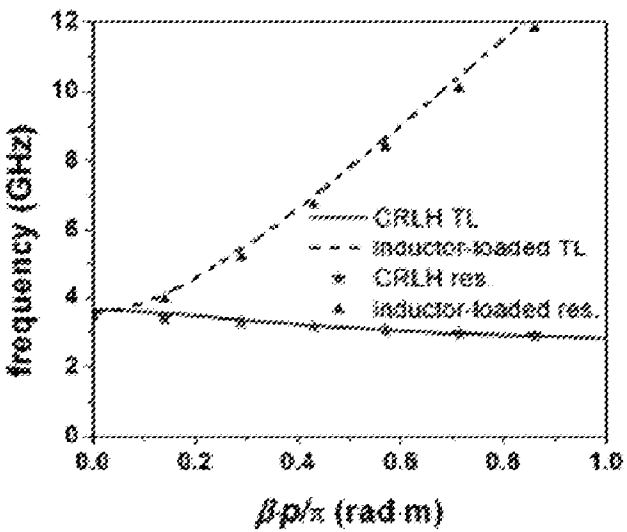

FIG. 17 is a graph of dispersion for the CRLH and inductor-loaded unit cells of FIG. 16A and FIG. 16B.

Figure 18A:
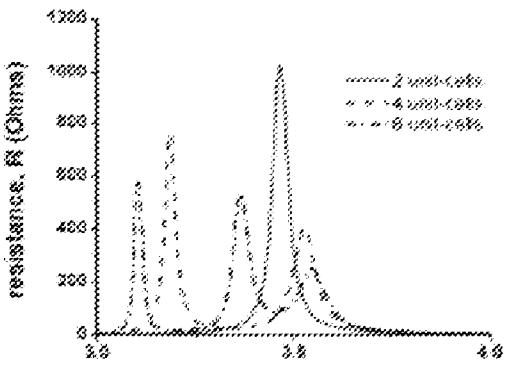

FIG. 18A is a graph of the real part (R) of CRLH antenna input impedance according to an aspect of the present invention.

Figure 18B:
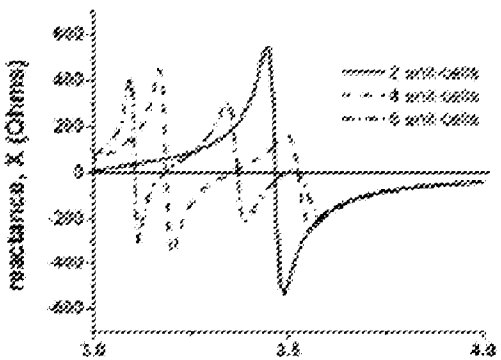

FIG. 18B is a graph of the imaginary part (X) of CRLH antenna input impedance according to an aspect of the present invention.

Figure 19A:
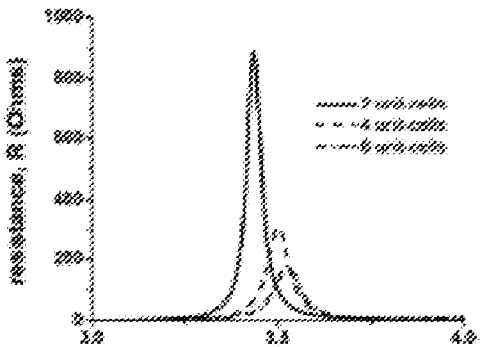

FIG. 19A is a graph of the real part (R) of inductor-loaded TL antenna input impedance according to an aspect of the present invention.

Figure 19B:
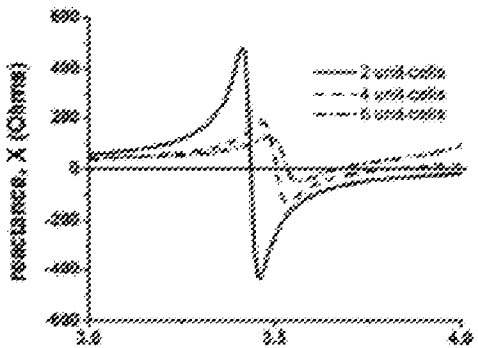

FIG. 19B is a graph of the imaginary part (X) of inductor-loaded TL antenna input impedance according to an aspect of the present invention.

Figure 20:
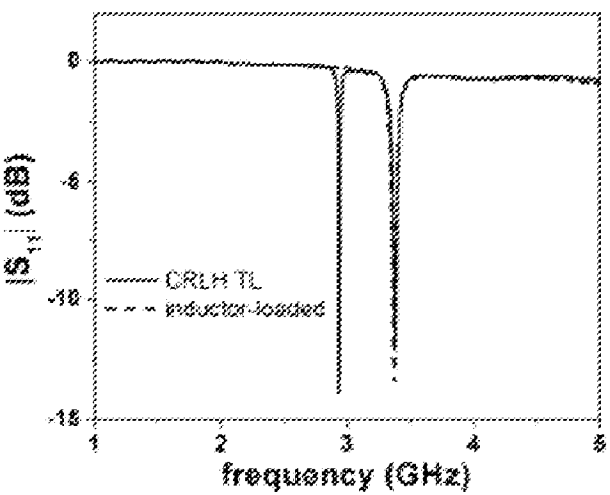

FIG. 20 is a graph of return loss for the CRLH and inductor-loaded two unit cell antennas according to aspects of the present invention.

Figure 21B:
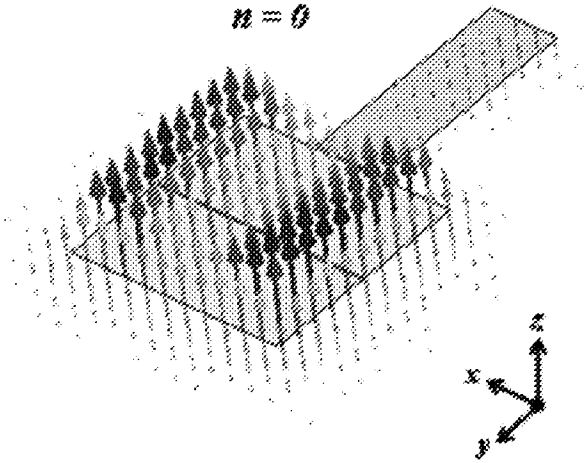
Figure 21A:
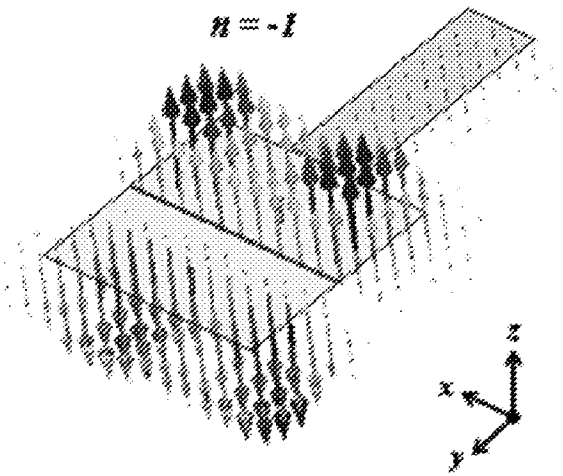

FIG. 21A is a 3D graph of electric field distribution beneath a two unit cell CRLH antenna according to an aspect of the present invention, shown at half-wavelength mode.

FIG. 21B is a 3D graph of electric field distribution beneath a two unit cell CRLH antenna according to an aspect of the present invention, shown at infinite-wavelength mode.

FIGS. 22A-22D are graphs of CRLH radiation patterns according to an aspect of the present invention, showing x-z, y-z, and x-y planes as well as cross-polarizations normalized to co-polarizations.

Figure 23A:
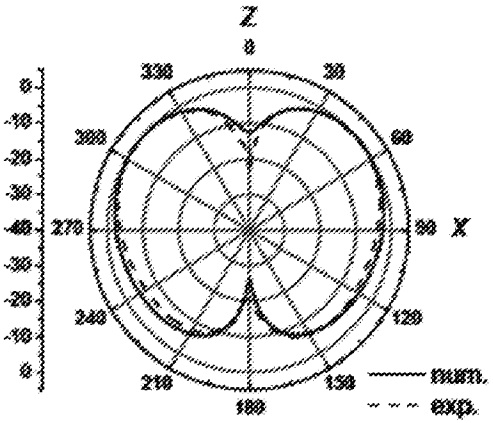
Figure 23B:
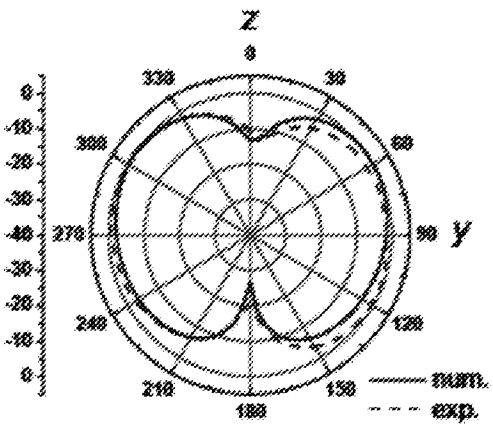

FIGS. 23A-23B are graphs of inductor-loaded antenna radiation patterns according to an aspect of the present invention, showing x-z and y-z planes.

Figure 24A:
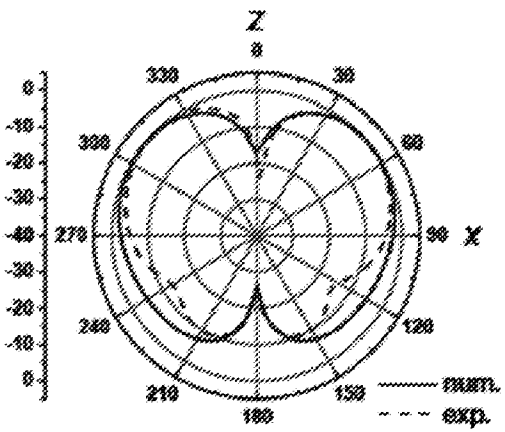
Figure 24B:
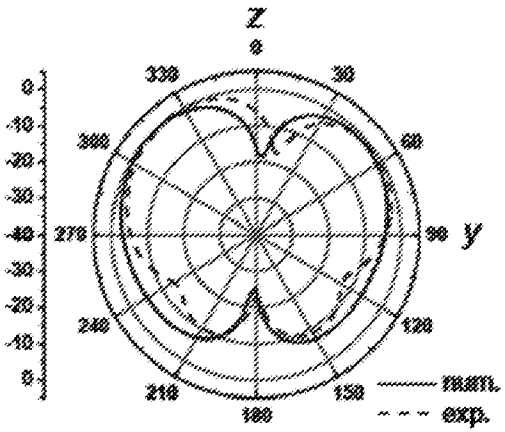

FIGS. 24A-24B are graphs of two unit-cell CRLH antenna radiation patterns according to an aspect of the present invention, showing x-z and y-z planes.

Figure 25A:
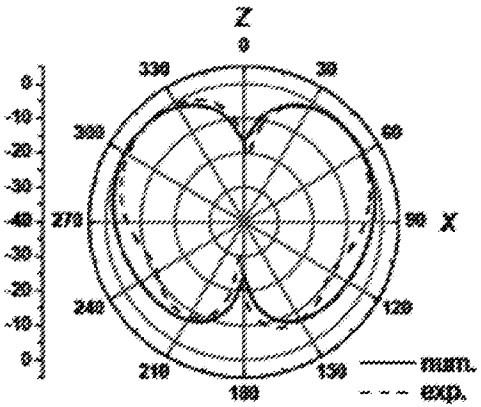
Figure 25B:
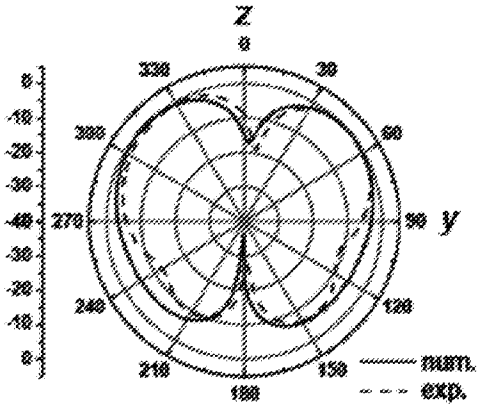

FIGS. 25A-25B are graphs of four unit-cell inductor-loaded antenna radiation patterns according to an aspect of the present invention, showing x-z and y-z planes.

Figure 26A:
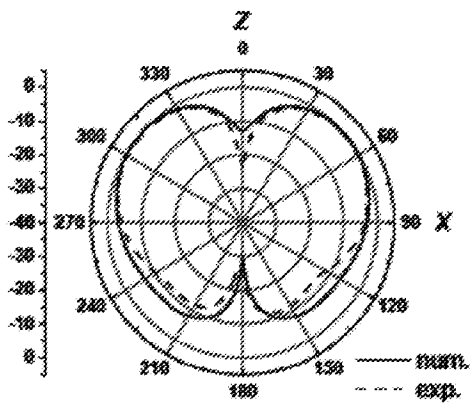
Figure 26B:
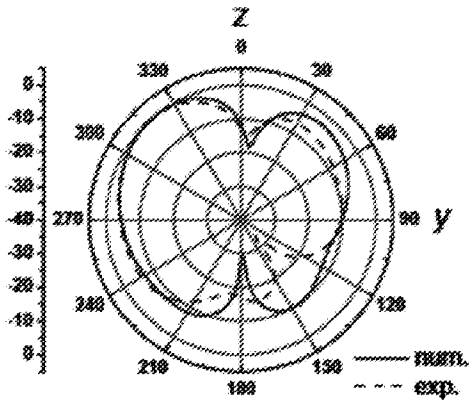

FIGS. 26A-26B are graphs of six unit-cell CRLH antenna radiation patterns according to an aspect of the present invention, showing x-z and y-z planes.

Figure 27B:
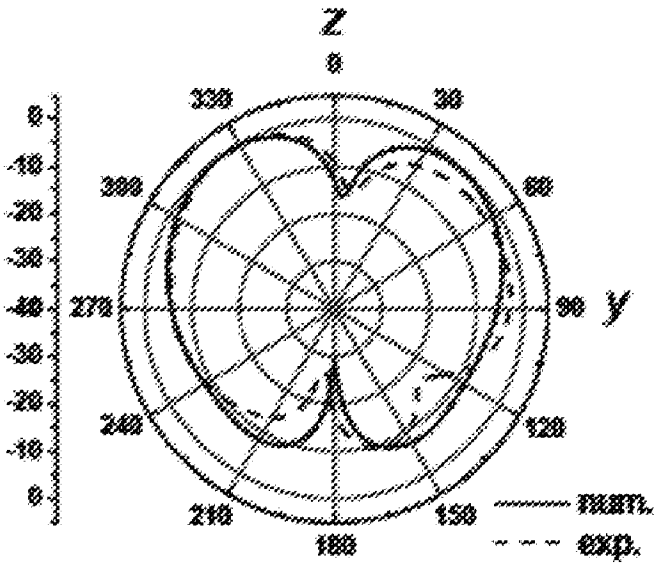
Figure 27A:
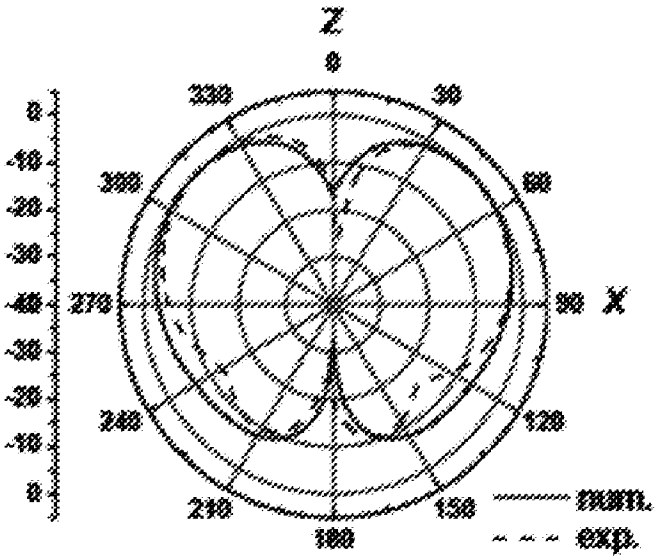

FIGS. 27A-27B are graphs of six unit-cell inductor-loaded antenna radiation patterns according to an aspect of the present invention, showing x-z and y-z planes.

Figure 28:
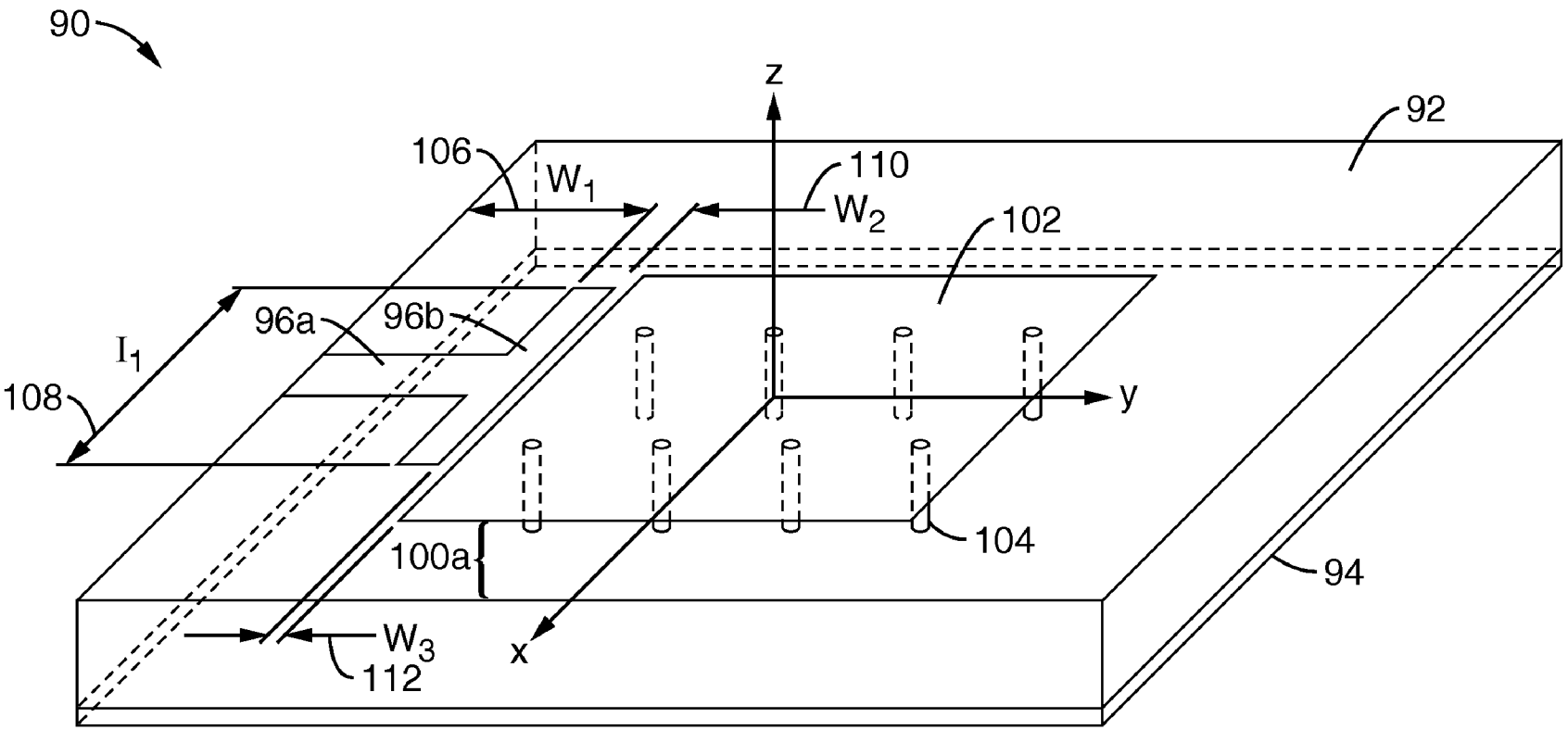

FIG. 28 is a schematic of an enlarged aperture monopolar antenna according to embodiment of the present invention.

Figure 29B:
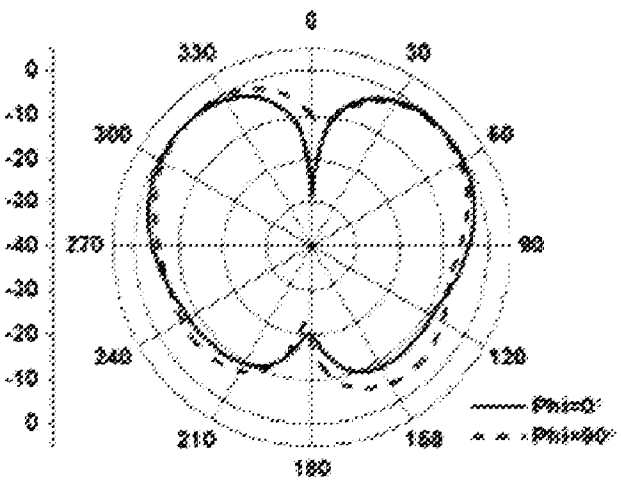
Figure 29A:
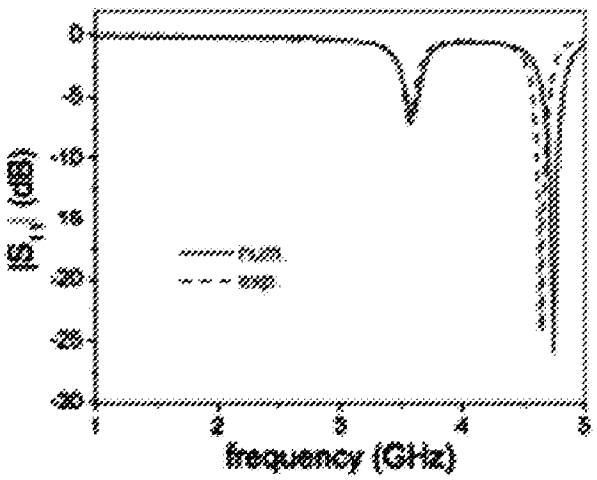

FIG. 29A is a graph of return loss for the monopolar antenna of FIG. 28.

FIG. 29B is a graph of the radiation pattern for the monopolar antenna of FIG. 28.

DETAILED DESCRIPTION OF THE INVENTION

Referring more specifically to the drawings, for illustrative purposes the present invention is embodied in the apparatus generally shown in FIG. 1 through FIG. 29B. It will be appreciated that the apparatus may vary as to configuration and as to details of the parts, and that the method may vary as to the specific steps and sequence, without departing from the basic concepts as disclosed herein.

1. Dual-Mode Microstrip Antenna Based on Backward Wave.

A dual-mode CRLH radiating element (e.g., antenna and/or resonator), is described for compact communication systems that benefit from radiation pattern selectivity, such as terrestrial communication systems with satellite uplinks and wireless local-area-networks (WLANs). Radiating elements described herein are generally referred to, for the sake of simplicity, as antennas although they may be alternately configured as resonators.

Unlike the dual-band CRLH half-wavelength antenna of S. Otto, C. Caloz, A. Sanada, and T. Itoh, "A dual-frequency composite right/left-handed half-wavelength resonator antenna," *Asia-Pacific Microwave Conference*, December 2004, the present antenna configuration can support a different radiation pattern at each operational frequency. By way of example and not limitation, the radiation patterns comprise a monopolar radiation pattern at one resonant frequency and a patch-like radiation pattern (similar to the pattern produced by the dominant mode of a classical patch antenna) at another resonant frequency. The antenna is based on the fundamental backward wave of the CRLH TL in which the supported wavelength is proportional to the operational frequency and the infinite wavelength supported by the CRLH TL at a finite frequency. The ability of this antenna to generate two different radiation patterns depends on the field distributions supported by the CRLH unit-cell which is discussed in the following sections.

1.1 Composite Right/Left-Handed Transmission Line Theory.

Figure 1:
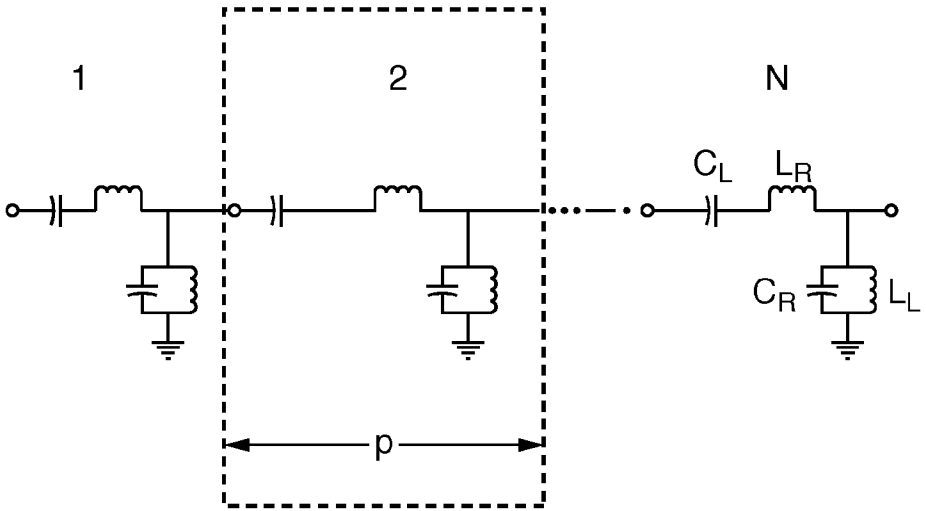
FIG. 1 is a schematic of a one-dimensional CRLH meta-material TL with N cells according to an aspect of the present invention.

FIG. 1 illustrates an equivalent circuit model of a CRLH TL, having a unit-cell consisting of an LH series capacitance (CO, an RH series inductance ($L_R$), an LH shunt inductance ($L_L$), and an RH shunt capacitance ($C_R$). The CRLH metamaterial TL is a practical realization of a purely left-handed (LH) TL, which takes into account unavoidable parasitic right-handed (RH) effects. By cascading a CRLH unit-cell of length p, N times, a CRLH TL of length N*p can be realized. The resonant condition of the CRLH TL is determined by $\beta L=n\pi$, where the resonance index, n, can be a negative integer, positive integer, or zero.

Figure 2:
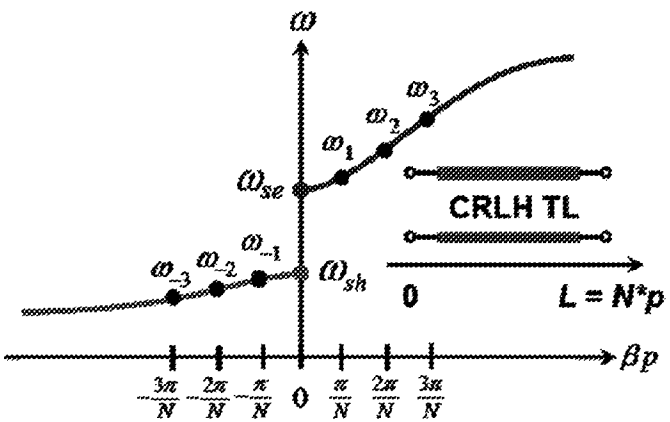
FIG. 2 is a graph of a dispersion curve for a CRLH TL composed of N unit cells according to an aspect of the present invention.

FIG. 2 depicts a dispersion diagram of a CRLH TL along with possible resonant operating points. By applying the Bloch-Floquet theorem to the CRLH TL unit-cell, the dispersion relation of the CRLH TL is determined to be $$\frac{n\pi}{N} = \cos^{-1}\left(1 - \frac{1}{2}\left(\frac{\omega_L^2}{\omega_n^2} + \frac{\omega_n^2}{\omega_R^2} - \frac{\omega_L^2}{\omega_{se}^2} - \frac{\omega_L^2}{\omega_{sh}^2}\right)\right), \text{ when } N = 1 \quad (1)$$

where $$\omega_L = \frac{1}{\sqrt{C_L L_L}}, \omega_R = \frac{1}{\sqrt{C_R L_R}}, \quad (2)$$
$$\omega_{se} = \frac{1}{\sqrt{C_L L_L}}, \omega_{sh} = \frac{1}{\sqrt{C_R L_L}}.$$

Since the dispersion relation of the CRLH TL can be controlled by properly designing its unit-cell, it is particularly well-suited for realizing compact antennas (or large antenna structures). In general, the series resonance ($\omega_{se}$) and the shunt resonance ($\omega_{sh}$) of the CRLH unit-cell are not equal, thus resulting in a band-stop region. A fundamental backward wave (i.e., anti-parallel group and phase velocities) is supported at frequencies below the band-stop. It is this fundamental backward wave that is used to realize the antenna for operation at the n=0 and n=−1 resonances. By changing the dispersion relation of the CRLH TL by Eq. (1), these two frequencies can be controlled. Unlike a conventional microstrip patch antenna, the operational frequencies of the antenna are not harmonics of each other. In addition, both operational frequencies are based on the fundamental backward mode supported by the CRLH TL.

At the n=0 resonance, an infinite wavelength ($\beta=0$, $\omega\neq0$) is supported by the CRLH TL. The n=0 resonance frequency is determined by $\omega_{sh}$ when the terminals of the CRLH TL are open-circuited. This constant field distribution can be used to generate a monopolar pattern depending on the unit-cell implemented. For the n=−1 resonance mode, a half-wavelength is supported by the CRLH TL. The n=−1 frequency is determined by the dispersion relation of the CRLH unit-cell and the number of unit-cells used to implement the CRLH TL as given by Eq. (1).

1.2 CRLH-Based Radiating Element Realization.

Figure 3:
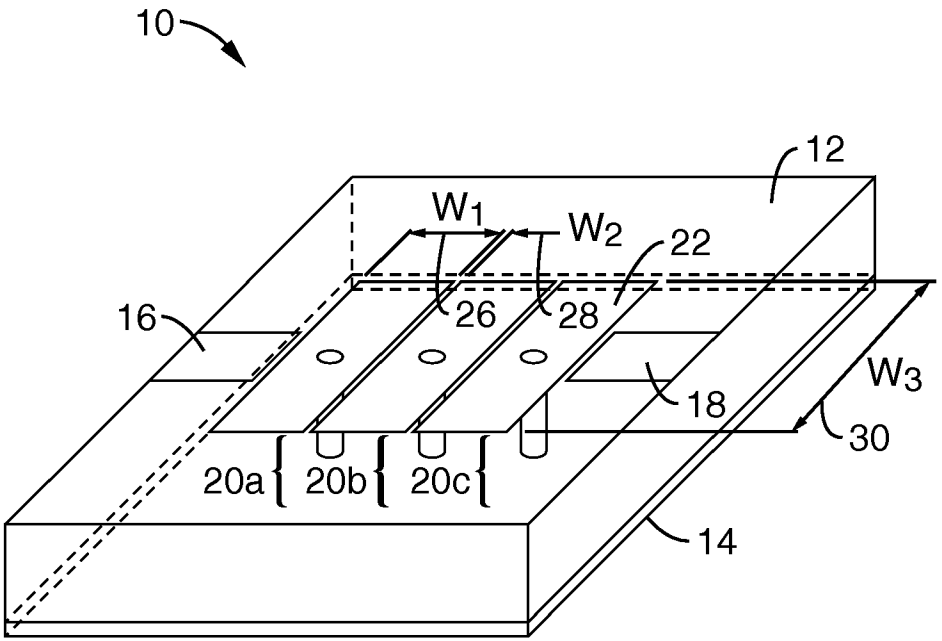
FIG. 3 is a schematic of a CRLH TL resonator according to an embodiment of the present invention.

FIG. 3 illustrates by way of example embodiment 10 a CRLH resonator on a base (substrate) 12 with ground plane 14. The CRLH TL resonator shown coupled to input 16 and output 18 and constructed with three CRLH unit-cells 20*a*, 20*b* and 20*c*, to verify the resonant operation frequencies of the CRLH unit-cell used to implement the resonator. Three resonance points occur in the backward mode region since three unit-cells are used to implement the resonator.

The CRLH unit-cell comprises a conductive patch 22 (e.g., a metallic patch) coupled to ground plane 14 by a via 24. The patch structure is based on a mushroom structure, which was chosen because of its symmetry that readily lends itself toward generating a monopolar pattern as discussed below. The width 26 of each patch 22 is shown in relation to a gap 28 between the unit-cells which contributes the left-hand capacitance attribute $C_L$ while via 24 contributes left-hand inductance attribute $L_L$. The length 30 of a patch region is also marked in the figure, and represented by way of example as being at least twice the width. It should be noted, however, that the aspect ratio of the patch can be varied depending on the application and configuration of the unit-cells.

The RH attributes are due to the current flow ($L_R$) on the unit-cell and from the electric field between the metal patch and the ground plane ($C_R$). By changing the equivalent circuit parameters of the unit-cell, the operational frequencies of the antenna can be controlled without changing its physical size.

By way of example and not limitation, the entire structure shown in the figure was implemented on RT/Duroid 5880 ($\in_R$=2.2, h=1.57 mm). Parameter extraction was performed on the CRLH unit-cell yielding $C_L$=0.46 pF, $C_R$=0.82 pF, $L_L$=1.50 nH, and $L_R$=0.29 nH. According to Eq. (1), the n=0 resonance occurs at 4.54 GHz and the n=−1 resonance occurs at 3.59 GHz.

Figure 4:
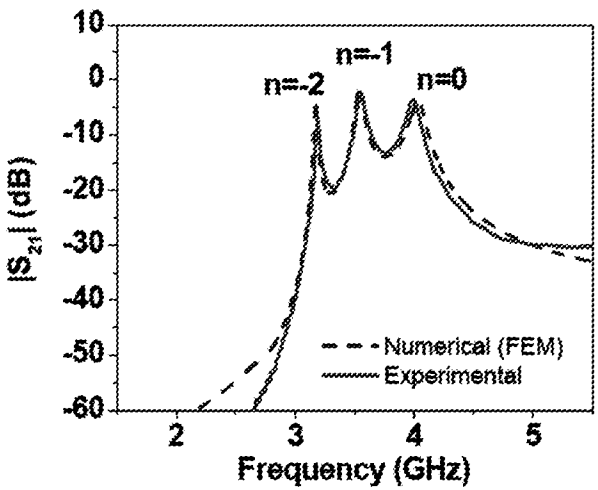
FIG. 4 is a graph of resonance peaks for the CRLH TL of FIG. 3.

FIG. 4 depicts resonant peaks for the embodiment shown in FIG. 3, with numerical and experimental resonance peaks; the n=0 resonance occurs at $f_0$=4.00 GHz and the n=−1 resonance occurs at $f_{-1}$=3.55 GHz. The results obtained from Eq. (1) deviate from the numerical and experimental results because of the inaccurate parameters extracted from the unit-cell.

Figure 5:
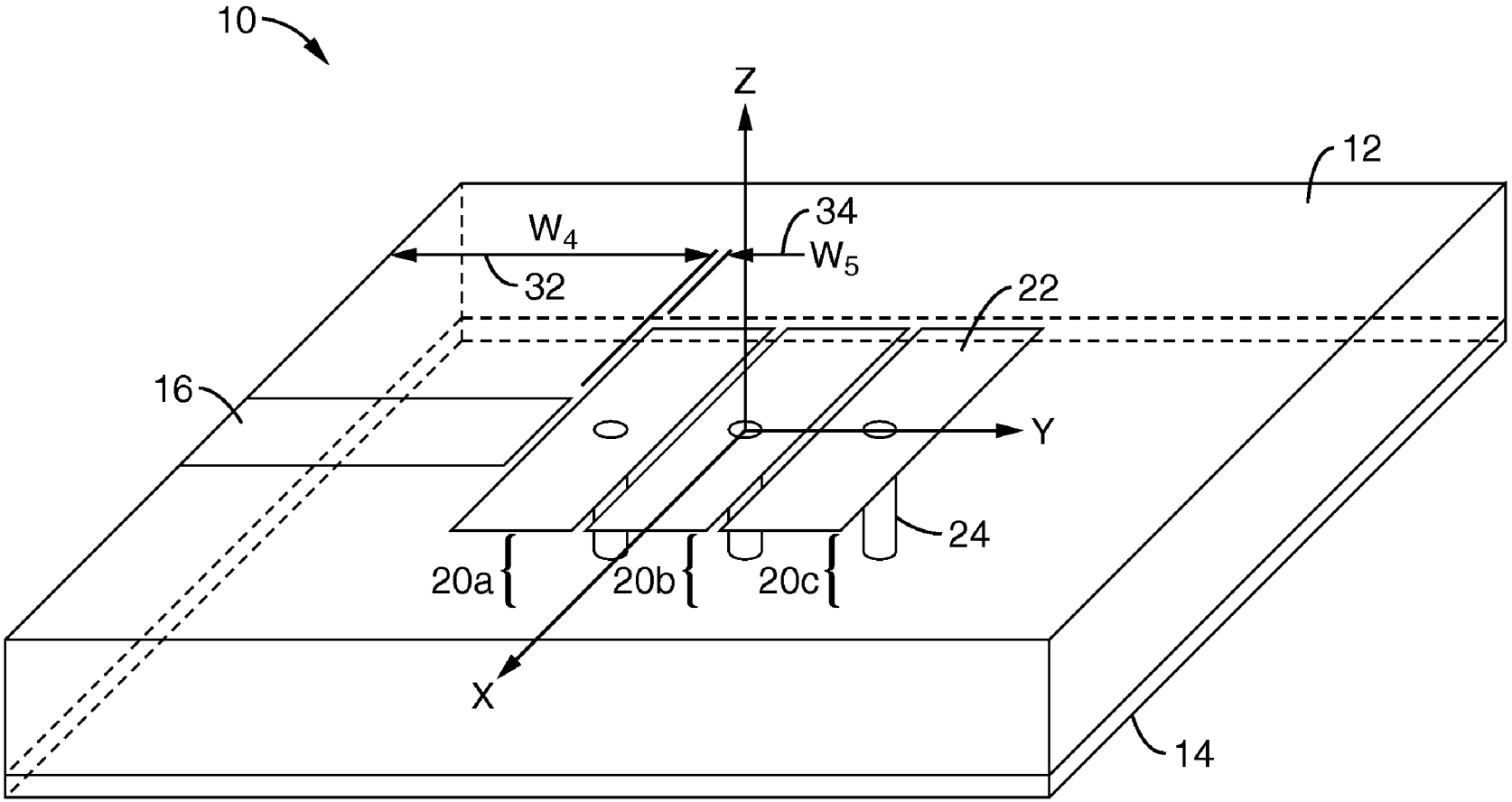
FIG. 5 is a schematic of a CRLH TL antenna according to an embodiment of the present invention.

FIG. 5 illustrates an embodiment of an antenna based on the CRLH resonator of FIG. 3. A single feed line 16 for exciting the antenna, is shown having length 32 in relation to gap 34 between the feed-line and the first patch.

Figure 6:
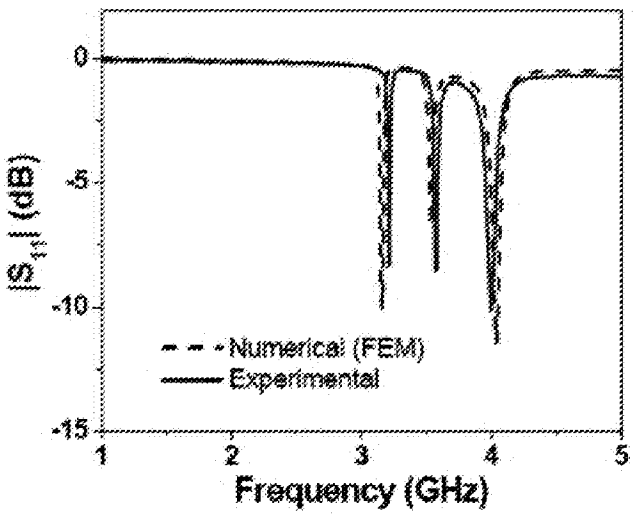
FIG. 6 is a graph of return loss for the antenna of FIG. 5.

FIG. 6 depicts numerical and experimental return losses for the antenna of FIG. 5. The graph indicates a return loss of −10.21 dB and −9.2 dB are experimentally obtained at the dual frequencies of $f_0$=4.00 GHz and at $f_{-1}$=3.57 GHz, respectively.

By way of example, the antenna size is $\lambda/5\times\lambda/5\times\lambda/50$ at a first frequency $f_0$ and $\lambda/5.7\times\lambda/5.7\times\lambda/54$ at a second frequency $f_{-1}$. At $f_0$, an infinite wavelength is supported by the CRLH TL and the electric-field along the perimeter of the patch formed by the three CRLH unit-cells is a constant. Therefore, the equivalent magnetic current densities along the edges of the patch form a magnetic loop, from which a monopolar radiation pattern is expected.

Figure 7:
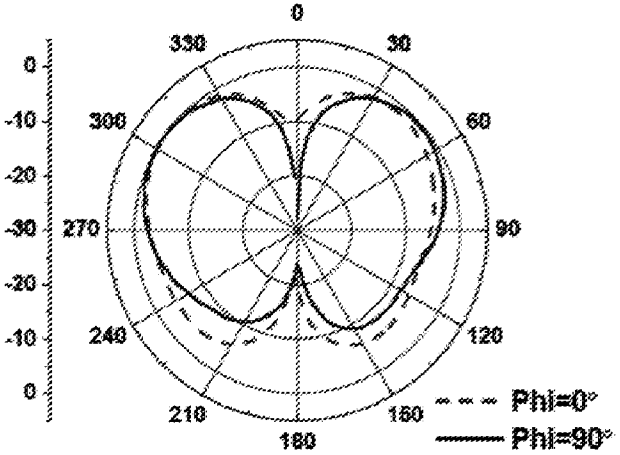
FIG. 7 is a graph of monopolar radiation pattern for a CRLH TL according to an aspect of the present invention.

FIG. 7 depicts an experimental confirmation of the monopolar radiation pattern obtained from the experimental test setup. A maximum gain of 2.3 dBi was achieved at $f_0$, while at $f_{-1}$, the electric-field distribution is a half-wavelength and only two edges contribute to the radiation in similar manner to the dominant mode of a classical patch antenna, wherein a patch-like radiation pattern is expected.

Figure 8:
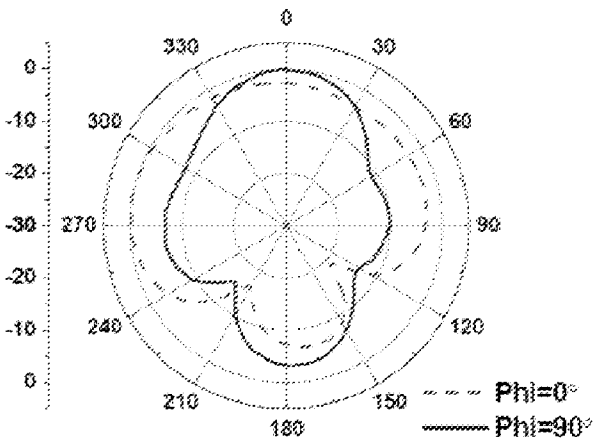
FIG. 8 is a graph of a patch-like radiation pattern of a CRLH TL according to an aspect of the present invention.

FIG. 8 depicts an experimental confirmation of the patch-like radiation pattern at $f_{-1}$. A maximum gain of −2.5 dBi was achieved at frequency $f_{-1}$.

Accordingly, the embodiment described above is a dual-mode compact microstrip antenna based on the fundamental backward wave supported by a composite right/left-handed (CRLH) meta-material transmission line (TL). This antenna is capable of monopolar radiation at one resonant frequency and patch-like radiation at another resonant frequency. Unlike a conventional microstrip patch antenna, the operational frequencies of the antenna are not harmonics of each other and can be controlled by modifying the dispersion relation of the CRLH unit-cell. The physical size and operational frequencies of the antenna are determined by the unit cell of the CRLH meta-material. Numerical and experimental results of a three unit-cell CRLH-based antenna were presented to verify operation of the antenna.

2. Infinite Wavelength Resonant Antennas with Monopolar Radiation.

2.1 Introduction.

In the following discussion, the analysis and design of resonant, planar antennas based on the fundamental infinite wavelength property of the CRLH TL is described in detail. Since an infinite wavelength occurs when the propagation constant is zero, the frequency of the antenna does not depend on its physical length, but only on the reactance provided by its unit-cell. Therefore, the physical size of the antenna can be arbitrary (not constrained by wavelength), which is important toward realizing electrically small or electrically large antennas. By properly designing the unit-cell, the radiation pattern of the antenna at the infinite wavelength frequency can also be tailored. In particular, it is shown that the CRLH TL unit-cell is the general model for the required unit-cell which consists of a series capacitance, a series inductance, a shunt capacitance, and a shunt inductance. The shunt resonance of the CRLH TL unit-cell determines the infinite wavelength frequency and thus the operational frequency of the antenna. As a result, a CRLH TL unit-cell without series capacitance referred to as an inductor-loaded TL unit-cell can also be used to realize the antenna. By modifying the equivalent shunt capacitance and/or shunt inductance circuit parameters of the unit-cell, the operational frequency and the physical size of the realized antennas can be controlled. Furthermore, the unique "equal amplitude/phase" electric-field distribution of an infinite wavelength excited on the antenna gives rise to a monopolar radiation pattern.

The periodic design methodology described herein offers a straight-forward design approach based on the characteristics of a single unit-cell. Based on this periodic structure methodology, CRLH antennas with monopolar radiation patterns are numerically and experimentally verified, such as in response to models which consist, by way of example, of two, four, or six unit-cells. Inductor-loaded antennas with monopolar radiation patterns consisting by way of example having two, four, and six unit-cells are also investigated. The input impedance, gain, and radiation pattern as a function of the number of unit-cells are examined for both types of antennas. The effect of adding unit-cells in the non-resonant dimension of the antenna are also investigated. In addition, the choice of CRLH unit-cell or inductor-loaded unit-cell for dual-mode antenna configurations is discussed.

2.2 Theory.

Since the infinite wavelength antenna is based on a periodic design approach, a unit-cell capable of supporting an infinite wavelength is discussed in the following sub-section. In addition, the monopolar radiation pattern of the infinite wavelength antenna is presented.

2.2.1 Fundamental Infinite Wavelength Unit-Cell.

FIG. 9A through FIG. 9C illustrates aspects of TL models and their dispersion characteristics. To realize a resonant-type planar antenna with no dependence on its physical size, a TL structure that supports an infinite wavelength at its fundamental mode is needed. First, infinitesimal lumped element circuit models are shown for a conventional RH TL model in FIG. 9A, and for the LH TL model in FIG. 9B. The lossless RH TL model consists of a series inductance per-unit length ($L_R'$) and a shunt capacitance per-unit length ($C_R'$), while the lossless LH TL consists of a series capacitance times-unit length ($C_L'$) and a shunt inductance ($L_L'$). The propagation constant of a TL is given by $\gamma=\alpha+j\beta=\sqrt{Z'Y'}$ where Z' and Y' are respectively the per-unit length impedance and the per-unit length admittance. Therefore the propagation constant for the lossless RH TL is given by:

$$\beta_{RH}=\omega\sqrt{C'_R L'_R}, \tag{3}$$

and for the lossless LH TL is $$\beta_{LH} = \frac{-1}{\omega\sqrt{C'_L L'_L}}. \tag{4}$$

The dispersion diagram of the RH and LH TL are shown in FIG. 9C. This diagram illustrates that neither a RH or LH TL structure can support an infinite wavelength at a non-zero frequency; the RH TL only has $\beta=0$ when $\omega=0$, while the LH TL has $\beta=0$ when $\omega=\infty$. Therefore, a RH and LH TL cannot be used to realize a fundamental infinite wavelength resonant antenna. A practical realization of a LH TL, which includes unavoidable RH effects, known as a CRLH TL is able to support an infinite wavelength ($\beta=0$ when $\omega\neq0$) and therefore can be used to realize the antenna.

Figure 10B:
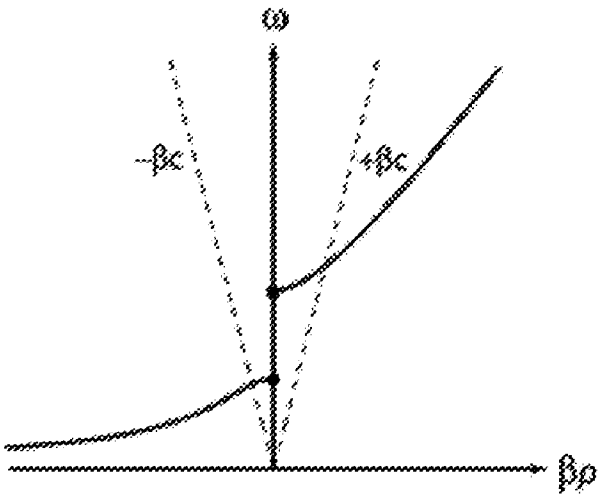
FIG. 10B is a graph of dispersion showing fundamental RH and LH modes according to an aspect of the present invention.
Figure 10A:
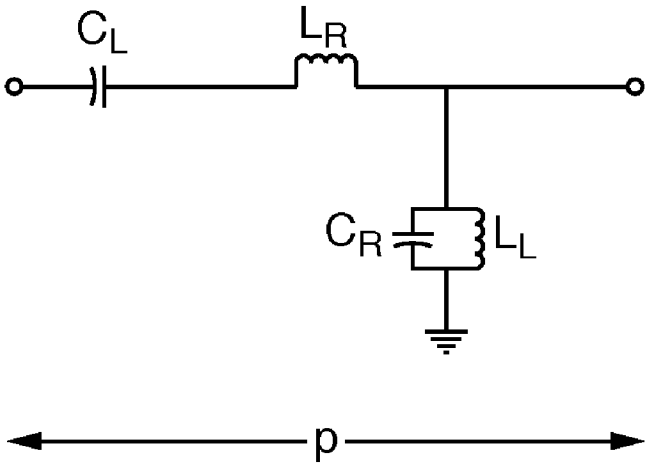
FIG. 10A is a schematic of a CRLH TL with LC unit cell of length p according to an aspect of the present invention.

FIG. 10A illustrates an equivalent circuit model for a CRLH TL unit-cell. By applying periodic boundary conditions related to the Bloch-Floquet theorem, the dispersion relation of the CRLH TL unit-cell is determined to be:

$$\beta(\omega) = \frac{1}{p}\cos^{-1}\left(1 - \frac{1}{2}\left(\frac{\omega_L^2}{\omega^2} + \frac{\omega^2}{\omega_R^2} - \frac{\omega_L^2}{\omega_{se}^2} - \frac{\omega_L^2}{\omega_{sh}^2}\right)\right), \tag{5}$$

where $$\omega_L = \frac{1}{\sqrt{C_L L_L}},\ \omega_R = \frac{1}{\sqrt{C_R L_R}},\ \omega_{se} = \frac{1}{\sqrt{C_L L_R}},\ \omega_{sh} = \frac{1}{\sqrt{C_R L_L}}. \tag{6}$$

FIG. 10B depicts a dispersion diagram for the CRLH TL unit-cell of FIG. 10A. It should be appreciated that the CRLH TL supports a fundamental LH wave (phase advance) at lower frequencies and a RH wave (phase delay) at higher frequencies.

In general, the series resonance ($\omega_{se}$) and the shunt resonance ($\omega_{sh}$) are not equal and two non-zero frequency points with $\beta=0$ are present. These two points are referred to as infinite wavelength points and are determined by the series resonance and shunt resonance of the unit-cell as given in Eq. (6). By cascading a CRLH TL unit-cell of length p, N times, a CRLH TL of length L=N*p can be realized. The CRLH TL can be used as a resonator under the resonance condition:

$$\beta_n = \frac{n\pi}{L} \tag{7}$$

where n is the resonance mode number and can be a positive or negative integer, or even zero. In the case where n=0, an infinite wavelength is supported and the resonance condition is independent of the length of the CRLH TL (i.e., number of unit-cells, N, can be arbitrary). In the case of open boundary conditions, the infinite wavelength frequency is determined by the shunt resonance frequency, $\omega_{sh}$. Since only the shunt resonance of the CRLH TL unit-cell determines the infinite wavelength frequency, the series components have no effect.

FIGS. 11A through 11B illustrate examples of four cell resonators. In FIG. 11A the resonator has the following parameters: $C_L$=1.50 pF, $L_R$=1.00 pF, $C_R$=1.45 pF, and $L_L$=1.95 nH, which corresponds to $f_{sh}$=3.0 GHz. The open-ended resonator is coupled to the input/output port with capacitors of $C_c$=0.01 pF. FIG. 11B depicts an open-ended resonator with the series capacitance CL components eliminated (CL becomes infinite).

Figure 12:
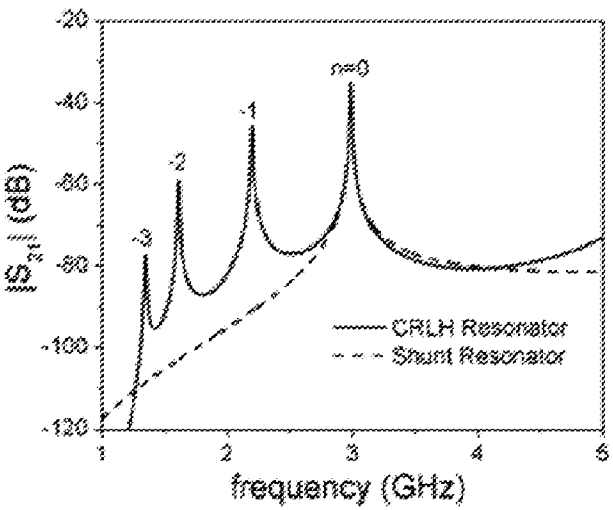

FIG. 12 depicts the resonance peaks of the two open-ended resonators above, and demonstrates that only the shunt components determine the infinite wavelength resonance in the case of open boundary conditions.

Therefore, an inductor-loaded TL unit-cell with the same shunt components as the CRLH TL unit-cell has the same infinite wavelength frequency as the CRLH TL unit-cell.

FIG. 13A illustrates a unit-cell of the inductor-loaded TL which has a propagation constant given by:

$$\beta(\omega) = \frac{1}{p}\cos^{-1}\left(1 + \frac{1}{2}\left(\frac{L_R}{L_L} - \frac{\omega^2}{\omega_R^2}\right)\right) \quad (8)$$

FIG. 13B depicts the dispersion diagram plotted for the inductor-loaded TL of FIG. 13A. The inductor-loaded TL has a DC-offset in similar manner as the CRLH TL, albeit the dispersion characteristics are quite different. It should be appreciated that phase advance or phase delay can occur for the CRLH TL, while only phase delay can occur for the inductor-loaded TL. Since the resonance condition of Eq. (7) is independent of the length of the CRLH TL or inductor-loaded TL at the infinite wavelength frequency, the open-ended resonators of FIG. 11A and FIG. 11B can be utilized according to the present invention for realizing size independent resonant antennas and resonators. Although the number of unit-cells used to realize an infinite wavelength resonator has no effect on its operational frequency $f_0$, the input impedance of the structure is dependent on the number of unit-cells and is given by:

$$Z_{in} = -jZ_o\cot(\beta l) \overset{\beta\to 0}{\approx} \frac{1}{NY}, \quad (9)$$

where Y is the admittance of the unit-cell, given by $Y=j(\omega C_R - 1/(\omega L_L))$.

2.2.2 Infinite Wavelength Antennas with Monopolar Radiation.

By using an open-ended resonator that supports an infinite wavelength, an infinite wavelength resonant antenna with an operational frequency independent of its physical size can be realized. Antennas having this configuration according to the invention can be made electrically large or small, the latter of which has been demonstrated previously with a patch-like pattern. In contrast, electrically large and small infinite wavelength antennas with monopolar radiation patterns are demonstrated herein. Various low-profile monopolar antennas have been realized based on reactive loading with shorting pins. However, the placement and number of shorting pins for these monopolar antennas were strictly based on numerical studies.

FIG. 14A and FIG. 14B illustrate microstrip patch antennas of equal dimension which are shown in order to discuss the radiation mechanisms behind the antenna. First, a conventional microstrip patch antenna as shown in FIG. 14A is discussed. The patch antenna can be modeled as a square cavity with perfect magnetic conductor (PMC) walls. At its fundamental mode, the patch antenna supports a half-wavelength along its resonant length. Therefore, the non-zero equivalent magnetic current density at each radiating edge is given by:

$$\vec{M}_S = -2\hat{n}\times\vec{E}, \quad (10)$$

where $\hat{n}$ is the unit normal to the edge, $\vec{E}$ is the electric field at the edge, and the factor of two is due to the ground plane. It is the two equivalent magnetic current densities at the radiating edges of the patch antenna that contribute to its radiation pattern. Next consider the CRLH antenna shown in FIG. 14B. Since the CRLH TL can support an infinite wavelength, the field distributions along the perimeter of the CRLH antenna are in-phase when operated at its infinite wavelength frequency. Therefore, the equivalent magnetic current densities at the edges described by Eq. (8) form a loop as shown in FIG. 14B. It is this equivalent magnetic loop that produces the monopolar radiation pattern; a magnetic loop is an ideal electric dipole by duality. As a result, the infinite wavelength antennas are polarized in the theta-direction.

2.3 CRLH TL Unit-Cell Realization.

As mentioned in section 2.2 the CRLH TL unit-cell is the general model for the monopolar unit-cell. To realize the required capacitances and inductances of the CRLH TL unit-cell model, a physical implementation has to be chosen. Lumped components or distributed structures can be used, but for radiation-type applications pure component-based structures are impractical due to their inability to radiate. Due to the popularity of microstrip technology for planar antennas, the CRLH TL unit-cell is based on microstrip.

FIG. 15 illustrates a CRLH embodiment 50 implemented as a two dimensional array on a ground plane 52 with unit cells, one of which is indicated at 54*a* comprising mushroom structures, which are one type of structure that can be utilized for realizing a CRLH TL. Each mushroom comprises a patch 56 (e.g., square) connected to ground plane 52 through a square metallic via 58 connected to the ground plane by a shorting post. The LH capacitance (CO of the mushroom is attributed to the edge coupling between the unit-cells and the LH inductance ($L_L$) of the mushroom is in response to the shorting post to ground. The RH effects are due to the capacitive coupling ($C_R$) between the patch and ground plane and the current flow atop the patch ($L_R$). By changing the physical properties of the mushroom unit-cell (e.g., patch size, shorting post radius, dielectric constant, and so forth), the equivalent capacitances and inductances can be controlled. When there is no gap between the mushroom unit-cells, the antenna structure an inductor-loaded TL. The interdigital-based CRLH TL unit-cell is another microstrip implementation of the CRLH TL unit-cell used for one-dimensional LH applications. The choice of the mushroom unit-cell over the interdigital-based unit-cell is for radiation pattern preference. In the case of the mushroom unit-cell, symmetrical boundary conditions similar to the center-shorted microstrip patch antenna exist and a monopolar radiation pattern is possible. In the case of the interdigital-based unit-cell antenna, a patch-like radiation is exhibited since there is only one radiating open-boundary.

2.4 Infinite Wavelength Resonant Antenna Realization.

In this section, several infinite wavelength antennas with monopolar radiation patterns are realized. The unit-cells for the antennas are based on a modified mushroom unit-cell, wherein the metallic patch can be rectangular and not need be a square. The size of the patch, the dielectric constant, the period of the unit-cell, the radius of the shorting post, and the number of unit-cells are all factors that control the dispersion curve of the unit-cell and in effect the resonant frequencies of the antenna. A CRLH TL unit-cell and an inductor-loaded TL unit-cell are used to realize the infinite wavelength antennas. Both types of unit-cells have similar shunt reactance and thus similar infinite wavelength frequency. To demonstrate this effect, antennas consisting of two, four, and six CRLH TL unit-cells and two, four, and six inductor-loaded TL unit-cells are realized. In the next sub-sections, the dimensions of the unit-cells, the input impedance of the antenna as a function of the number of unit-cells, and the radiation pattern/gain of the antennas are discussed.

2.4.1 Antenna Design.

FIG. 16A and FIG. 16B illustrate general models 70, 70' of CRLH TL and the inductor-loaded TL based infinite wavelength antennas, respectively, implemented on a circuit board (or substrate) material 72 having at least one ground plane 74. In both figures, at least a first feed line 76 leads to unit cells 80*a*, 80*b*. In FIG. 16A each unit cell comprises conductive patch 82 with conductive via 84 connecting it to the ground plane. A gap 86 is defined between the conductive patches for each unit cell in FIG. 16A. In FIG. 16B a single conductive patch 82' (no gaps) is connected to the ground plane with multiple vias 84. The figures depict the use of proximity coupling as the feed network for the antennas. However, it should be recognized that different feed mechanisms can be adopted, while the feeding method can vary in response to the number of unit-cells (N) utilized. Feed line 76 is shown having length 86 and separated by a gap 88 from conductive patch 82.

By way of example and not limitation, all the antennas described below are realized on a circuit board comprising a Rogers RT/Duroid 5880 material having a dielectric constant $\in_R$=2.2 and thickness h=1.57 mm. The CRLH TL unit-cell measures 7.3×15 $mm^2$ with a period of 7.5 mm, while the inductor loaded TL unit-cell measures 7.5×15 $mm^2$ with a period of 7.5 mm. The radius of the shorting post is 0.12 mm for both unit-cells. Therefore, the infinite wavelength frequency for these unit-cells are very similar.

FIG. 17 depicts calculated dispersion diagrams for the unit-cells of FIG. 16A and FIG. 16B along with experimental resonant peaks of a five unit-cell open-ended resonator implementation. The infinite wavelength frequency for the CRLH TL unit-cell is 3.65 GHz and is 3.52 GHz for the inductor-loaded TL unit-cell as predicted by applying periodic boundary conditions on a single unit-cell. In contrast, the five unit-cell resonator implementation predicts an infinite wavelength frequency of 3.51 GHz and 3.50 GHz for the CRLH TL unit-cell and for the inductor-loaded TL unit-cell, respectively. By modifying the patch area or the radius of the shorting post of the unit-cell, the infinite wavelength frequency can be controlled.

2.4.2 Input Impedance.

FIGS. 18A-18B and FIGS. 19A-19B depict computed impedance characteristics of a CRLH antenna according to the invention. The input impedance ($Z_{in}$=R+jX Ω) of each antenna implementation is computed, such as utilizing Ansoft HFSS v10. A 50Ω line was directly attached to the input edge of each antenna and de-embedded to calculate the input impedance. The real part and imaginary component of the input impedance for the CRLH TL based antennas are shown in FIGS. 18A and 18B, respectively.

The real part and imaginary component of the input impedance for the inductor-loaded TL based antennas are shown in FIG. 19A and FIG. 19B, respectively. It should be appreciated that the resonant frequency of an antenna is generally defined as the frequency where the reactance is equal to zero. However, it can be observed from FIG. 19B that the reactance curve does not cross zero as the number of cells is increased. As a result, the resonant frequency of the antenna is defined as the frequency where the resistance reaches a maximum, independent of the value of reactance. The input impedance and corresponding infinite wavelength resonant frequency obtained from HFSS for the antennas are summarized in Table 1.

From Table 1, it can be observed that the infinite wavelength frequency increases slightly as the number of unit-cells increases. This characteristic arises in response to the additional mutual coupling between the unit-cells, which affects the resonance frequency. Although the inductor-loaded antennas do not have series capacitance, their infinite wavelength frequency is very similar to the CRLH antennas. In addition, the input impedance follows the trend predicted by Eq. (9); wherein the input impedance decreases as the number of unit-cells increases. Also, it is noted that the input reactance of the CRLH based antenna becomes capacitive as more unit-cells are added, while the input reactance of the inductor-loaded antenna becomes increasingly inductive with the addition of more unit-cells.

2.4.3 Two Unit-Cell Antenna Realization.

The input impedance for both the CRLH and inductor-loaded two unit-cell antennas is quite high for quarter wavelength matching. Therefore, proximity coupling is relied upon in these examples for matching both antennas to a 50Ω line as shown in the example of FIG. 16A and FIG. 16B having feed length 86 $w_1$=15.0 mm and gap 88 $w_2$=0.2 mm.

FIG. 20 depicts experimental return loss of the CRLH and inductor-loaded two unit-cell antennas, shown in FIG. 16A and FIG. 16B. For the CRLH based antenna, a return loss of −12.34 dB is obtained at $f_0$=3.38 GHz, while a return loss of −13.91 dB at $f_0$=3.37 GHz is obtained for the inductor-loaded antenna. The electrical size of the antennas is λ/6×λ/6×λ/57 at $f_0$. These results show that the two unit-cell antenna is not matched exactly at the predicted infinite wavelength frequency of Table 1, which is due to the high input resistance of the antenna.

FIG. 21A and FIG. 21B depict electric-field distribution underneath the two unit-cell CRLH antennas, shown in FIG. 16A and FIG. 16B, for the n=−1 (βl=−180°) and n=0 modes, respectively.

Ansoft HFSS was used to obtain these field plots. The n=−1 mode distribution shows that the electric-field is 180° out-of-phase corresponding to a half-wavelength. As a result, the equivalent magnetic current densities along the perimeter of the antenna for the n=−1 mode form a distribution comparable to FIG. 14B and the radiation pattern will be similar to a conventional patch antenna. The n=0 distribution shows that the electric-field is in-phase verifying that an infinite wavelength is supported. Therefore, the equivalent magnetic current densities along the perimeter of the antenna for the n=0 mode form a loop comparable to FIG. 14B and a monopolar radiation occurs. By using the n=−1 and n=0 mode, the antennas can be used in dual-mode applications.

The field distribution of the infinite wavelength antenna shown in FIG. 21B is similar to the $TM_{01}$ mode of a conventional circular patch antenna. However, the $TM_{01}$ mode is a higher order mode which makes the conventional circular patch antenna impractical for compact wireless devices. By placing a shorting post at the center of the conventional circular patch antenna, the $TM_{01}$ becomes the fundamental mode. In addition, a mode similar to $TM_{01}$ mode of the circular patch can be excited in non-circular patches, which are shorted in the center, to produce a fundamental monopolar radiation pattern.

Figure 22A:
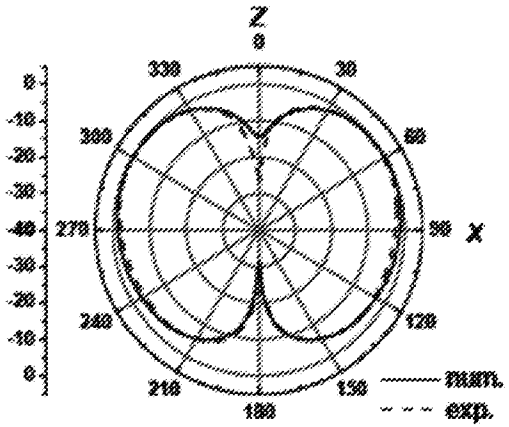
Figure 22B:
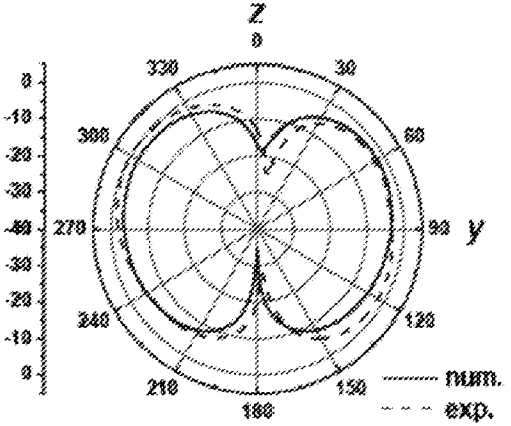
Figure 22C:
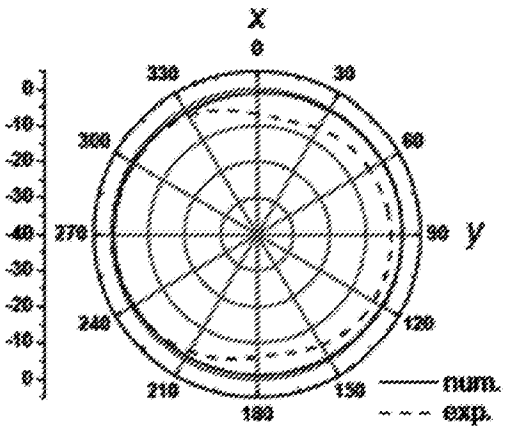
Figure 22D:
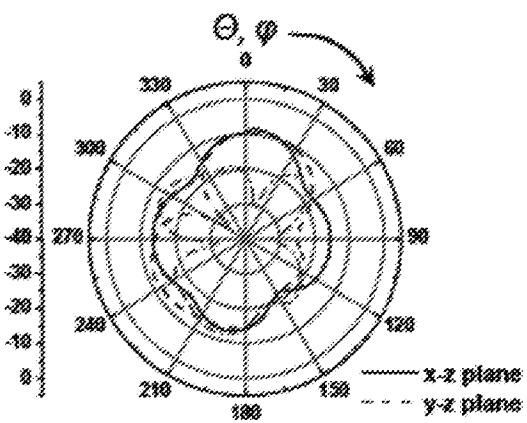

FIGS. 22A-22D and FIGS. 23A-23B illustrate radiation patterns for two unit cell CRLH and inductor-loaded antennas, respectively. The numerical and experimental radiation patterns of the CRLH and inductor-loaded antennas shown in these figures reveal the expected monopolar radiation pattern. FIG. 22A and FIG. 22B depict radiation patterns in the Z direction with Phi=0° (x-z plane) and Phi=90° (y-z plane), respectively. FIG. 22C depicts radiation in the X direction (x-y plane) with Theta=90°. FIG. 22D depicts cross-polarizations normalized to co-polarizations, shown with patterns in the x-z, y-z and x-y planes.

A maximum gain of 0.87 dBi and 0.70 dBi is experimentally obtained for the CRLH TL based antenna and for the inductor-loaded TL based antenna, respectively. In addition, the x-y plane radiation pattern and cross-polarization (normalized relative to co-polarization) of the CRLH antenna are shown in FIG. 22C and FIG. 22D, respectively. FIG. 22C illustrates the omni-directional coverage in the x-y plane provided by the monopolar antenna, while FIG. 22D shows that the cross-polarization is less than the co-polarization. The inductor-loaded antenna has similar x-y plane and cross-polarization patterns. These patterns verify that the antennas are polarized in the theta-direction as discussed in Section 2.2.2.

2.4.4 Effect of Increasing the Number of Unit-Cells.

The embodiments of FIG. 16A and FIG. 16B are extended into four and six unit-cell antennas along the y-direction. In this example a single section quarter wavelength transformer is used to match each four and six unit-cell antenna to a 50Ω line. Only the real part of the input impedance shown in Table 1 is considered in the matching. The experimental infinite wavelength frequency, return loss, and gain of the two, four, and six unit-cell antennas are displayed in Table 2. The electrical size of the four unit-cell antennas is $\lambda/6\times\lambda/3\times\lambda/53$ at $f_0$ and the electrical size of the six unit-cell antennas is $\lambda/6\times\lambda/2\times\lambda/53$ at $f_0$. Although the antennas become physically larger, the infinite wavelength frequency remains approximately constant. In addition, gain increases as the antenna becomes physically larger. The x-y plane and cross-polarization of the four and six unit-cell CRLH antennas are similar to those of the two unit-cell CRLH antenna and therefore are not shown.

FIG. 24A through FIG. 27B depict radiation patterns for different antenna configurations. The predicted infinite wavelength frequencies of Table 1 show good agreement with the measured infinite wavelength frequencies of Table 2. The numerical and experimental radiation patterns for the CRLH and inductor-loaded four unit-cell antennas are shown in FIGS. 24A-24B and FIGS. 25A-25B, respectively. While, the numerical and experimental radiation patterns for the CRLH and inductor-loaded four unit-cell antennas are shown in FIGS. 26A-26B and FIGS. 27A-27B, respectively. The expected monopolar pattern is obtained. It should be noted, however, that the pattern is asymmetrical in the y-z plane, which can be attributed to the feed and that the antenna is operated in the fast-wave region as seen in FIG. 18B and FIG. 21B, which means that the unit-cell is inherently radiative. This asymmetry can be eliminated by using a coaxial feed at the center of the antenna.

2.4.5 Effect of Increasing Unit-Cells in Non-Resonant Direction.

FIG. 28 illustrates a four inductor-loaded unit cell antenna embodiment 90 shown on a circuit board 92 (or substrate) having a ground plane 94. A feed-line is shown with input section 96*a* coupled to a coupling region 96*b*. One of the unit cells, 100*a*, is shown comprising conductive plate 102 coupled through conductive via 104 to ground plane 94. The feed line is shown with input length $w_1$ 106 coupled to coupling region 96*b* having a span of $l_1$ 108 and a width $w_2$ 110, separated from the unit cells by gap $w_3$ 112.

The previous sections showed the effect of adding unit-cells along the resonant length of the antenna. In this section, it is shown that unit-cells can be added to the non-resonant direction of the antenna to increase gain and to avoid the asymmetrical radiation pattern present in the six unit-cell antenna realizations with an edge feed. The antenna is depicted in FIG. 28, which consists of four inductor-loaded unit-cells in the y-direction and two inductor-loaded unit-cells in the x-direction forming a square antenna aperture. The inductor-loaded unit-cells are the same as the ones used to realize the antennas presented in Section 2.4.3 and Section 2.4.4. The feed utilized for the two unit-cell antennas is slightly modified with the addition of coupling region 96*b* in order to excite the entire structure.

FIG. 29A through FIG. 29B depict numerical and experimental return loss of the enlarged antenna, along with experimental return loss for an enlarged aperture antenna, respectively. These graphs also depict the original two unit-cell inductor-loaded antenna for comparison.

An experimental return loss of −6.4 dB is obtained at $f_0$=3.58 GHz. The shift in the infinite frequency is due to the increased mutual coupling attributed to the additional unit-cells. The electrical size of the antennas is $\lambda/3\times\lambda/3\times\lambda/53$ at $f_0$. The experimental radiation patterns at $f_0$=3.58 GHz are plotted in FIG. 29B and confirm the expected monopolar radiation pattern. A maximum gain of 5.72 dBi is obtained with a more symmetric radiation pattern than the six unit-cell antennas of Section 2.4.4.

The discussion above demonstrates the design of infinite wavelength resonant antennas based on periodic structures. The frequency of the antenna does not depend on its physical length, but only on the reactance provided by its unit-cell. In particular, the infinite wavelength supported by a composite right/left-handed unit-cell and an inductor-loaded unit-cell were used to realize several monopolar antennas. The infinite wavelength frequency is determined by the shunt resonance of the unit-cell. Since the physical length of the monopolar antenna is independent of the resonance phenomenon at the infinite wavelength frequency, a monopolar antenna can be arbitrary sized. To demonstrate these concepts, six antennas with differing numbers of unit-cells are numerically and experimentally realized with the composite right/left-handed unit-cell and an inductor-loaded unit-cell. Although, the resonant length of the antenna is increased by 200%, only a 4.7% frequency shift was obtained for the six unit-cell antenna in comparison to the two unit-cell antenna.

The analysis of resonant-type antennas based on the fundamental infinite wavelength supported by certain periodic structures has been presented. Since the phase shift is zero for a unit-cell that supports an infinite wavelength, the physical size of the antenna can be arbitrary; wherein antenna size is independent of resonance phenomenon. The operational frequency of the inventive antenna depends only on its unit-cell, while the physical size of the antenna depends on the number of unit-cells. In particular, the unit-cell is based on the composite right/left-handed (CRLH) meta-material transmission line (TL). It has been shown that the CRLH TL is a general model for the required unit-cell, which includes a non-essential series capacitance for the generation of an infinite wavelength. The analysis and design of the unit-cell has been discussed based upon field distributions and dispersion diagrams. It was also shown that the supported infinite wavelength can be used to generate a monopolar radiation pattern. Infinite wavelength resonant antennas have been realized with different numbers of unit-cells to demonstrate the infinite wavelength resonance.

Dual-band radiating structures were exemplified in the specification; however, one of ordinary skill in the art will appreciate that the teachings herein can be utilized in creating radiators having any desired number of discrete resonant frequencies.

Although the description above contains many details, these should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

TABLE 1

Input Impedance and Corresponding Resonant Frequency of CRLH Antennas

| Cell Type | No. Cells | frequency (GHz) | $Z_{in}$ = R + jX (Ω) |
|---|---|---|---|
| (CRLH) | 2 | 3.47 | 1060.1 + j0.0 |
| | 4 | 3.53 | 410.0 − j15.0 |
| | 6 | 3.55 | 253.0 − j73.0 |
| Inductor-loaded | 2 | 3.44 | 890.0 + j0.0 |
| | 4 | 3.51 | 310.0 + j20.6 |
| | 6 | 3.53 | 178.8 + j41.0 |

TABLE 2

Results for Two, Four, and Six Unit-cell Antennas

| Cell Type | No. Cells | frequency (GHz) | return loss (dB) | peak gain (dBi) |
|---|---|---|---|---|
| (CRLH) | 2 | 3.38 | −12.34 | 0.87 |
| | 4 | 3.52 | −17.33 | 4.50 |
| | 6 | 3.55 | −11.17 | 5.17 |
| inductor-loaded | 2 | 3.37 | −13.91 | 0.70 |
| | 4 | 3.49 | −20.50 | 4.17 |
| | 6 | 3.53 | −35.02 | 5.00 |

What is claimed is:

1. A multi-mode resonant radiating element, comprising:

a plurality of composite right/left-handed (CRLH) transmission line (TL) unit-cells configured for operation at multiple radio frequency bands;

each said unit-cell comprising a conductive patch connected to a ground plane through a via; and said plurality of unit-cells forming a resonator;

wherein said radiating element radiates an $i^{th}$ radiation pattern at the $i^{th}$ resonant frequency, and a, $j^{th}$ radiation pattern at a different $j^{th}$ resonant frequency;

wherein said $i^{th}$ radiation pattern is of a different shape than said $j^{th}$ radiation pattern; and wherein a single patch spans a plurality of said unit cells and connects to said ground plane through a plurality of vias in forming an inductor-loaded transmission line unit-cell implementation.

2. A radiating element as recited in claim 1:

wherein said via provides inductance $L_L$ as a left-handed (LH) attribute; and wherein right-hand (RH) attributes are in response to inductance ($L_R$) arising in response to current flow on the unit-cell, and from a capacitance ($C_R$) arising in response to an electric field between the conductive patch and the ground plane within each of said plurality of unit-cells.

3. A radiating element as recited in claim 1, wherein said resonant radiating element comprises either a resonator having at least a first and a second feed line, or an antenna having at least one feed line.

4. A radiating element as recited in claim 1, wherein said first radiation pattern is a monopolar radiation pattern operating at infinite wavelength.

5. A radiating element as recited in claim 1, wherein said second radiation pattern is a patch-like radiation pattern.

6. A radiating element as recited in claim 1, wherein the first and second resonant frequencies of the radiating element are not constrained to being harmonics of one another.

7. A dual-mode resonant radiating element, comprising:

a plurality of composite right/left-handed (CRLH) transmission line (TL) unit-cells;

each said unit-cell comprising a conductive patch connected to a ground plane through a via; and said plurality of unit cells forming a resonator;

wherein said radiating element radiates a monopolar radiation pattern at a first resonant frequency, and a patch-like radiation pattern at a second resonant frequency; and wherein a single patch spans a plurality of said unit cells and connects to said ground plane through a plurality of vias in forming an inductor-loaded transmission line unit-cell implementation.

8. A radiating element as recited in claim 7:

wherein the via provides inductance $L_L$ as a left-handed (LH) attribute;

wherein right-handed (RH) attributes are in response to inductance ($L_R$) arising in response to current flow on the unit-cell, and from a capacitance ($C_R$) arising in response to an electric field between the conductive patch and the ground plane within each of said plurality of unit-cells; and wherein said plurality of unit-cells forms an inductor-loaded transmission line (TL).

9. A radiating element as recited in claim 7, wherein the operational frequencies of the radiating element can be controlled by changing the equivalent circuit parameters of the unit-cell without changing its physical size.

10. A radiating element as recited in claim 7, wherein said resonant radiating element comprises either a resonator having at least a first and a second feed line, or an antenna having at least one feed line.

11. A radiating element as recited in claim 7, wherein resonant operation arises in response to the fundamental backward wave of the CRLH TL, in which the supported wavelength is proportional to the operational frequency and the infinite wavelength supported by the CRLH TL at a finite frequency.

12. A radiating element as recited in claim 7, wherein the first and second resonant frequencies of the radiating element are not limited to being harmonics of one another.

13. A radiating element as recited in claim 7, wherein said plurality of composite right/left-handed (CRLH) transmission line (TL) unit-cells comprise a plurality of vias connecting at least one conductive plate to a ground plane.

14. A radiating element as recited in claim 7:

wherein the operational frequencies of the radiating element are not subject to having a harmonic relationship; and wherein the operational frequencies of the radiating element are controlled by modifying the dispersion relation of the CRLH unit-cell.

15. A radiating element as recited in claim 7, wherein physical size and operational frequencies of the radiating element are determined by the unit cell of the CRLH metamaterial.

16. A dual-mode, resonant radiating element, comprising:

a plurality of composite right/left-handed (CRLH) transmission line (TL) unit-cells;

at least one conductive patch;

a ground plane; and a plurality of vias coupled between said at least one conductive patch and said ground plane forming an inductor-loaded transmission line (TL);

said via provides an inductance $L_L$ as a left-handed (LH) attribute;

wherein right-handed (RH) attributes arise in response to inductance $L_R$ from current flow on the unit-cell, and in response to capacitance $C_R$ from an electric field between the conductive patch and the ground plane;

wherein said radiating element radiates a monopolar radiation pattern at a first resonant frequency and a patch-like radiation pattern at a second resonant frequency;

wherein the first and second resonant frequencies are not constrained to being harmonics of one another; and wherein a single patch spans a plurality of said unit cells and connects to said ground plane through a plurality of vias in forming an inductor-loaded transmission line unit-cell implementation.

* * * * *